US012221311B2

(12) United States Patent
Oguchi et al.

(10) Patent No.: US 12,221,311 B2
(45) Date of Patent: Feb. 11, 2025

(54) MEDIUM STACKING APPARATUS AND POSTPROCESSING APPARATUS

(71) Applicant: SEIKO EPSON CORPORATION, Tokyo (JP)

(72) Inventors: Takeru Oguchi, Chino (JP); Masaki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 175 days.

(21) Appl. No.: 17/815,890

(22) Filed: Jul. 28, 2022

(65) Prior Publication Data

US 2023/0036816 A1 Feb. 2, 2023

(30) Foreign Application Priority Data

Jul. 30, 2021 (JP) ..... 2021-125468

(51) Int. Cl.

| | |
|---|---|
| ***B65H 37/04*** | (2006.01) |
| ***B65H 29/22*** | (2006.01) |
| ***B65H 31/34*** | (2006.01) |
| ***B65H 31/36*** | (2006.01) |

(52) U.S. Cl.

CPC ..... *B65H 29/22* (2013.01); *B65H 37/04* (2013.01)

(58) Field of Classification Search

CPC ..... B65H 31/36; B65H 31/34; B65H 31/02; B65H 37/04; B65H 29/22

See application file for complete search history.

(56) References Cited

U.S. PATENT DOCUMENTS

| | | | | |
|---|---|---|---|---|
| 6,354,588 | B1 * | 3/2002 | Kuwahara | B65H 31/02 271/224 |
| 2001/0010193 | A1 * | 8/2001 | Tsurumaki | B65H 31/02 101/477 |
| 2012/0292849 | A1 * | 11/2012 | Komatsu | B65H 83/025 271/220 |
| 2021/0309481 | A1 | 10/2021 | Shimada et al. | |

FOREIGN PATENT DOCUMENTS

| | | | |
|---|---|---|---|
| JP | 2002-249275 | | 9/2002 |
| JP | 2005104734 | A * | 4/2005 |
| JP | 2015071465 | A * | 4/2015 |
| JP | 2021-160913 | | 10/2021 |

* cited by examiner

*Primary Examiner* — Luis A Gonzalez
(74) *Attorney, Agent, or Firm* — WORKMAN NYDEGGER

(57) ABSTRACT

A stacking unit includes a processing tray, an alignment section, a transport section, and a moving section. The processing tray has a placement area in which one or more paper sheets are placed. The alignment section aligns leading edges of the paper sheets. The transport section transports the paper sheets to the alignment section. The moving section moves the paper sheets in ±X directions. The alignment section includes: a first alignment surface having a first friction coefficient; and a second alignment surface having a second friction coefficient. The second alignment surface is positioned upstream of the first alignment surface in a +A direction and closer to a center of the placement area in the ±X directions than the first alignment surface is.

10 Claims, 17 Drawing Sheets

MEDIUM STACKING APPARATUS AND POSTPROCESSING APPARATUS

The present application is based on, and claims priority from JP Application Serial Number 2021-125468, filed Jul. 30, 2021, the disclosure of which is hereby incorporated by reference herein in its entirety.

BACKGROUND

1. Technical Field

The present disclosure relates to a medium stacking apparatus and a postprocessing apparatus.

2. Related Art

JP-A-2002-249275 discloses a sheet-medium alignment apparatus having an end-fence block with a sawtooth surface. When a paper sheet comes into contact with the surface of the end-fence block, the leading edge of the paper sheet is suppressed by this surface from entering into the space between the surface and other paper sheets stacked vertically.

In the configuration disclosed above, the paper sheets are stacked with their leading edges being in contact with the vertically uneven surface. Thus, when the apparatus moves these paper sheets in a width direction intersecting the transport direction, a load involved in this movement may become heavy, as compared to a configuration without such an uneven surface. Furthermore, this configuration needs to have a dedicated moving mechanism when moving the end-fence block away from the paper sheets. In such cases, the configuration of the sheet-medium alignment apparatus may be complicated.

SUMMARY

According to an aspect of the present disclosure, a medium stacking apparatus includes: a placement section having a placement area in which one or more media that recorded medium are placed; an alignment section that aligns downstream, leading edges, in a transport direction, of the media that were transported to the placement section; a transport section that transports, to the alignment section, the media that were transported to the placement section; and a moving section that moves the media stacked on the placement section in a width direction, the width direction intersecting the transport direction. The alignment section includes: a first alignment surface having a first friction coefficient for contact with the media; and a second alignment surface having a second friction coefficient for contact with the media, the second friction coefficient being lower than the first friction coefficient. The second alignment surface is positioned upstream of the first alignment surface in the transport direction and closer to a center of the placement area in the width direction than the first alignment surface is.

According to another aspect of the present disclosure, a postprocessing apparatus includes: the above medium stacking apparatus; and a processing section that processes the plurality of media stacked on the placement section.

DESCRIPTION OF EXEMPLARY EMBODIMENTS

Figure 1:
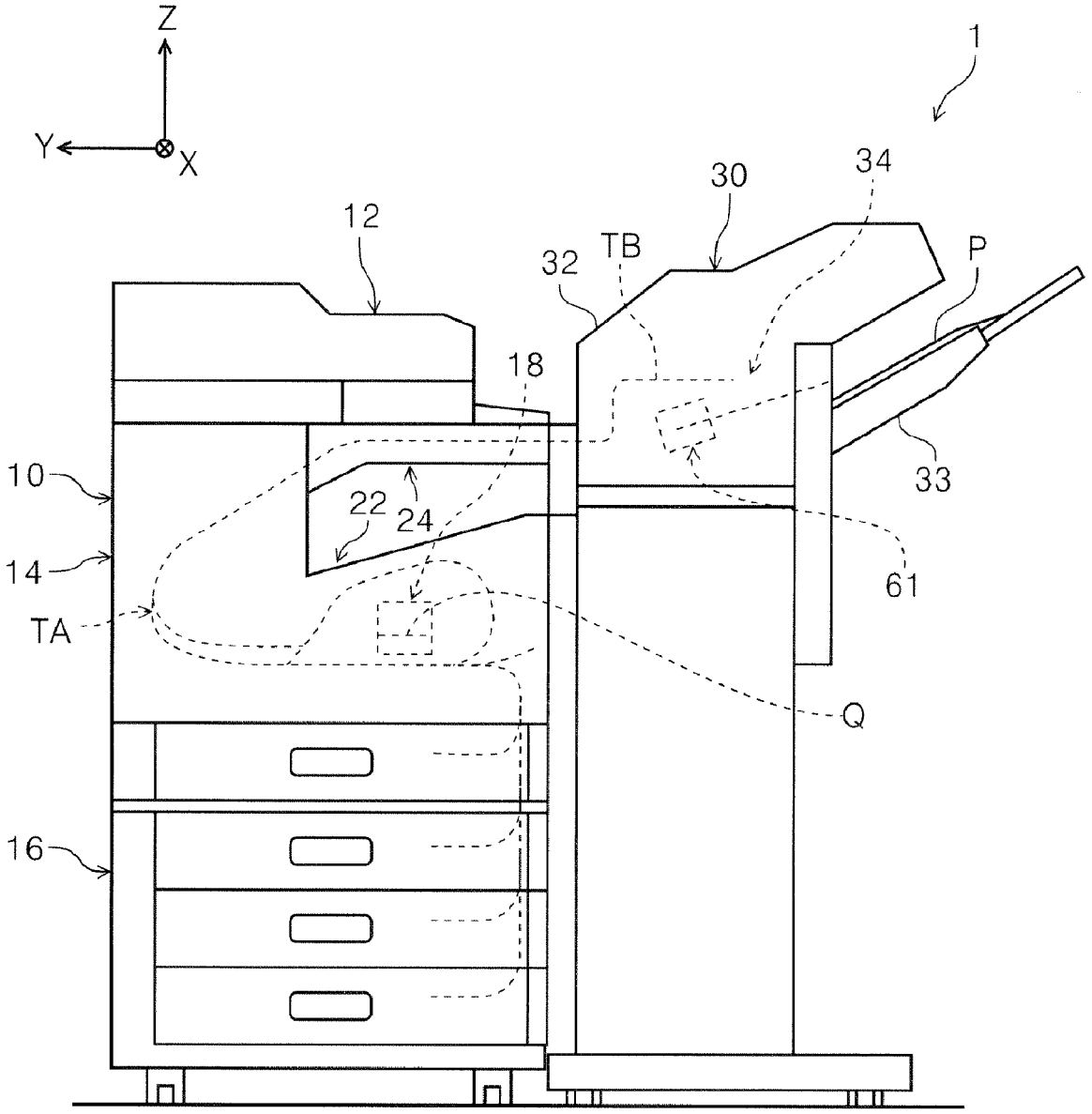
FIG. 1 illustrates an overall configuration of a record system according to a first embodiment of the present disclosure.

Some aspects of the present disclosure will be described briefly below. According to a first aspect of the present disclosure, a medium stacking apparatus includes: a placement section having a placement area in which one or more media that recorded medium are placed; an alignment section that aligns downstream, leading edges, in a transport direction, of the media that were transported to the placement section; a transport section that transports, to the alignment section, the media that were transported to the placement section; and a moving section that moves the media stacked on the placement section in a width direction, the width direction intersecting the transport direction. The alignment section includes: a first alignment surface having a first friction coefficient for contact with the media; and a second alignment surface having a second friction coefficient for contact with the media, the second friction coefficient being lower than the first friction coefficient. The second alignment surface is positioned upstream of the first alignment surface in the transport direction and closer to a center of the placement area in the width direction than the first alignment surface is.

Suppose an uppermost one of a plurality of media stacked on the placement section is transported over the other media, and this uppermost medium is warped. When transported to the alignment section by the transport section, the uppermost medium may be angled with respect to a straight line extending in the transport direction or the width direction. Following this, a portion of the downstream, leading edge of the angled uppermost medium in the transport direction might come into contact with the first alignment surface and then unexpectedly move toward the placement section. With the first aspect, however, the first alignment surface, the first friction coefficient of which is higher than the second friction coefficient of the second alignment surface, applies a relatively large friction force to the portion of the leading edge in the direction opposite to the moving direction. Therefore, this configuration can suppress this portion from entering into the space between the alignment section and the downstream, leading edges of the media that have already been stacked.

When the uppermost medium is further transported, the portion of the leading edge of the medium is curled, and another portion of the leading edge reaches substantially the same location as this curled portion in the transport direction. Then, the pressing force that the transport section has applied to the uppermost medium is released, so that the angle of the uppermost medium is corrected. In this case, the other portion of the leading edge is in contact with the second alignment surface. Since the second alignment surface is positioned upstream of the first alignment surface in the transport direction, the leading edge of the uppermost medium comes off the first alignment surface and, in turn, comes into contact with the second alignment surface during the correction of the angle of the uppermost medium. As a result, portions of the leading edges of the plurality of media, including the uppermost medium, stacked on the placement section come into contact with the second alignment surface.

When the moving section moves the plurality of media including the uppermost medium in the width direction, the second alignment surface, the second friction coefficient of which is lower than the first friction coefficient of the first friction member, applies a relatively small friction force to the leading edges of the paper sheets in the direction opposite to the moving direction. Thus, the moving section can move the media in the width direction with only a light load placed on the media. With the first aspect, the medium stacking apparatus can be formed with a simple configuration because it is unnecessary to move the first alignment surface or the second alignment surface.

According to a second aspect of the present disclosure, the medium stacking apparatus of the first aspect may have a configuration in which the alignment section further includes a third alignment surface positioned closer to the center in the width direction than the second alignment surface is. In addition, the third alignment surface may have a third friction coefficient for contact with the media, the third friction coefficient being higher than the second friction coefficient. The third alignment surface may be positioned downstream of the second alignment surface in the transport direction.

In the second aspect, when the medium is further transferred in the transport direction after the leading edge of the medium has come into the second alignment surface, the center of the medium in the width direction comes into contact with the third alignment surface. In this case, even if the leading edge of the medium moves toward the placement section, the third alignment surface, the third friction coefficient of which is higher than the second friction coefficient of the second alignment surface, applies a relatively large friction force to the center, in the width direction, of the medium in the direction opposite to the moving direction. Therefore, this configuration can suppress the leading edge of the medium in the transport direction from entering into the space between the third alignment surface and the leading edges of the media that have already been stacked. Moreover, since the third alignment surface is disposed downstream of the second alignment surface in the transport direction, the media come into contact with the third alignment surface less frequently than the second alignment surface. Therefore, the moving section can move the plurality of media in the width direction under only a light load.

According to a third aspect of the present disclosure, the medium stacking apparatus of the second aspect may have a configuration in which the first alignment surface is positioned upstream of the third alignment surface in the transport direction.

When the medium is angled with respect to a straight line extending in the transport direction, one corner of the leading edge of the medium is transported ahead of the other corner and is positioned downstream of the center of the leading edge of the medium in the transport direction. In other words, the downstream corner of the leading edge of the angled medium is positioned ahead of the center thereof in the transport direction. With the third aspect, the first alignment surface is positioned upstream of the third alignment surface in the transport direction. The downstream corner of the leading edge of the medium thus comes into contact with the first alignment surface having a relatively high friction coefficient earlier than when the center thereof comes into contact with the third alignment surface having a relatively low friction coefficient. This configuration can suppress the medium from entering into the space between the first alignment surface and the leading edges, in the transport direction, of the media that have already been stacked. Moreover, when the moving section moves the plurality of media in the width direction after the angle of the medium has been corrected by bringing the leading edge into contact with the first alignment surface, these media come into contact with the second alignment surface having a relatively low friction coefficient. Therefore, the moving section can move the media in the width direction under only a light load.

According to a fourth aspect, the medium stacking apparatus of the second aspect may have a configuration in which the third alignment surface is positioned upstream of the first alignment surface in the transport direction.

When the medium being transferred toward the alignment section is not angled or is slightly angled, the center of the leading edge of the medium in the width direction may be positioned downstream of the corner thereof in the transport direction after the leading edge of the medium has come into contact into the second alignment surface. With the fourth aspect, the third alignment surface is positioned upstream of the first alignment surface in the transport direction. The center of the leading edge of the medium being transported ahead of the corner thereof thus comes into contact with the third alignment surface having a relatively high friction coefficient earlier than the corner does. This configuration can suppress the medium from entering into the space between the third alignment surface and the leading edges, in the transport direction, of the media that have already been stacked. Moreover, when the moving section moves the plurality of media in the width direction after the angle of the medium has been corrected by bringing the leading edge of the medium into contact with the third alignment surface, these media come into contact with the second alignment surface having a relatively low friction coefficient. As a result, the moving section can move the media under only a light load.

According to the fifth aspect, the medium stacking apparatus of one of the first to fourth aspects may have a configuration in which the alignment section includes a plurality of first alignment surfaces and a plurality of second alignment surfaces. Further, the plurality of first alignment surfaces may be arranged on both sides of the placement area with respect to the center in the width direction; the plurality of second alignment surfaces may be arranged on both sides of the placement area with respect to the center in the width direction.

Even when the medium being transferred to the alignment section is angled, the leading edge of the medium can reliably come into contact with the first alignment surface and the second alignment surface in this order, independently of its angled orientation, more specifically regardless of which corner, in the width direction, of the leading edge of the medium is positioned ahead.

According to a sixth aspect, the medium stacking apparatus of one of the first to fifth aspects may have a configuration in which the first friction coefficient of the first alignment surface is higher than the second friction coefficient of the second alignment surface at least in a stacking direction of the media.

With the sixth aspect, since the first friction coefficient of the first alignment surface is higher than the second friction coefficient of the second alignment surface at least in the stacking direction, it is possible to suppress the downstream, leading edge of the medium from entering into the space between the alignment section and the downstream, leading edges of the media that have already been stacked on the placement section. Therefore, the medium being transported to the placement section does not affect the alignment of the leading edges of the media that have already been stacked.

According to a seventh aspect, the medium stacking apparatus of one of the first to sixth aspects may have a configuration in which the alignment section further includes a first friction member provided with the first alignment surface and a mounting member to which the first friction member is attached.

With the seventh aspect, the first friction member provided with the first alignment surface is replaceable. Thus, when the first alignment surface is worn out, it is only necessary to replace the first friction member provided with this first alignment surface without replacing the entire alignment section. It is consequently possible to avoid discarding many components in the process of replacing the first alignment surface.

According to an eighth aspect, the medium stacking apparatus of the seventh aspect may have a configuration in which the second alignment surface is formed on a second friction member, the second friction member being attached to at least one of the mounting member and the first friction member.

With the eighth aspect, the second friction member provided with the second alignment surface is replaceable. Thus, when the second alignment surface is worn out, it is only necessary to replace the second friction member provided with this second alignment surface without replacing the entire alignment section. It is consequently possible to avoid discarding many components in the process of replacing the second alignment surface.

According to a ninth aspect, the medium stacking apparatus of the seventh aspect may have a configuration in which the second alignment surface is formed on the mounting member.

With the ninth aspect, the medium stacking apparatus can be fabricated without performing a process of attaching a member provided with the second alignment surface to the mounting member.

According to a tenth aspect, a postprocessing apparatus includes: the medium stacking apparatus according to one of the first to ninth aspects; and a processing section that processes the plurality of media stacked on the placement section.

With the tenth aspect, the moving section can move the plurality of media in the width direction with only a light load placed on the media, thereby reducing the risk of the media being distorted.

First Embodiment

A description will be given below in detail of a record system 1, a postprocessing apparatus 30, and a stacking unit 34 according to a first embodiment, which is an example of the present disclosure. As illustrated in FIG. 1, the record system 1 includes a printer 10, a scanner unit 12, and the postprocessing apparatus 30, for example. The record system 1 may be an ink jet recording system that discharges an ink Q onto a paper sheet P, thereby recording desired information thereon. In this case, the ink Q is an example of a liquid; the paper sheet P is an example of a medium.

Some accompanying drawings employ an X-Y-Z coordinate system. The ±X directions are examples of a depth direction of the record system 1: the +X direction corresponds to the X-arrow direction, and the −X direction corresponds to the direction opposite to the X-arrow direction. Also, the ±X directions are examples of a width direction of the paper sheet P. The ±Y directions are examples of a width direction of the record system 1: the +Y direction corresponds to the Y-arrow direction, and the −Y direction corresponds to the direction opposite to the Y-arrow direction. The +Z directions, which are orthogonal to the ±X and ±Y directions, are examples of a height direction of the record system 1: the +Z direction corresponds to the Z-arrow direction, and the −Z direction corresponds to the direction opposite to the Z-arrow direction. Hereinafter, the +Z direction is also referred to as the upper direction; the −Z direction is also referred to as the lower direction.

The printer 10 is an example of a recoding apparatus that records information on a paper sheet P. The printer 10 includes: for example, a main body 14; a sheet storage section 16 that accommodates paper sheets P; a paper sheet transport section (not illustrated) that transports the paper sheets P; a recording section 18 that records information on the paper sheets P; an inside discharge section 22 that ejects the paper sheets P; a relay unit 24 via which the paper sheets P are to be transported to the postprocessing apparatus 30; and a controller (not illustrated). In the main body 14, a transport route TA along which the paper sheets P are to be transported is formed.

The recording section 18, which may be formed as a line head, has a plurality of nozzles (not illustrated) arranged so as to cover the entire surface area of a paper sheet P in the +X direction. The recording section 18 is supplied with the ink Q from an ink tank (not illustrated) and discharges the ink Q onto the paper sheet P through the nozzles, thereby recording information on the paper sheet P. The controller in the printer 10 includes a central processing unit (CPU), read-only memory (ROM), random access memory (RAM), and a storage unit, all of which are not illustrated. The controller controls the operations of individual sections in the record system 1, such as the transporting of the paper sheets P in the record system 1, the recording of information in the recording section 18, and the postprocess performed by the postprocessing apparatus 30.

The postprocessing apparatus 30 includes an apparatus main body 32, an ejection tray 33, the stacking unit 34, and a stapler 61. The stacking unit 34 is an example of a medium stacking apparatus; the stapler 61 is an example of a processing section. The apparatus main body 32 receives the paper sheets P transported from the printer 10. The apparatus main body 32 houses the stacking unit 34, the stapler 61, and a transport route TB along which the paper sheets P are to be transported.

Figure 2:
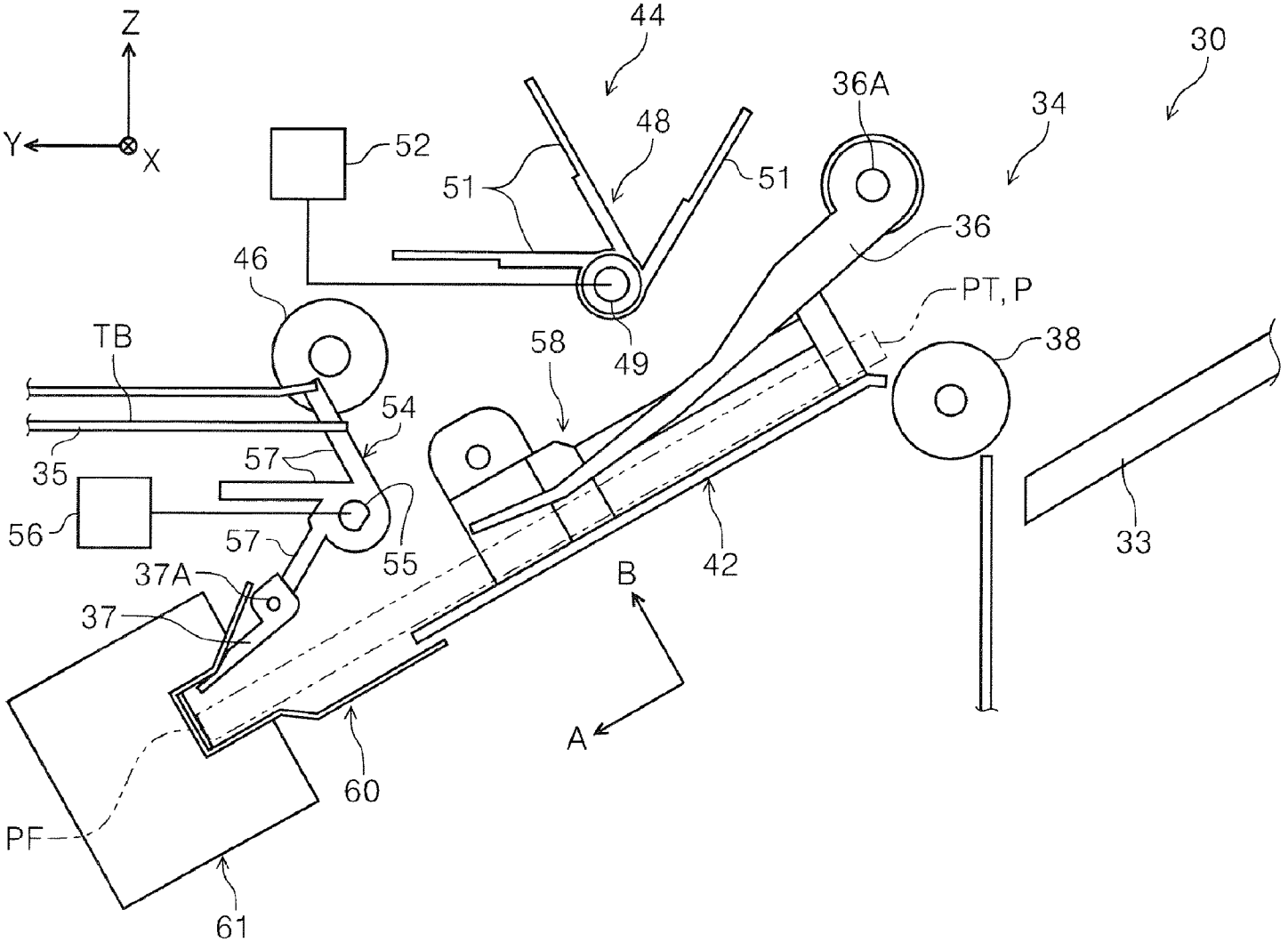
FIG. 2 schematically illustrates a processing tray and its surrounding portion of the postprocessing apparatus in the record system.

As illustrated in FIG. 2, the stacking unit 34 includes a processing tray 42, an alignment section 60, a transport section 44, and a moving section 58. The stacking unit 34 further includes a guide member 35, a press member 36, a flap 37, and an ejection roller 38. In this embodiment, the direction in which a paper sheet P is to be transported by the stacking unit 34 is defined as a +A direction, which may be orthogonal to the ±X directions as viewed from the +Z direction and may intersect the ±Y directions as viewed from the +X direction. In addition, a straight line extending in the +A direction is angled with respect to each of straight lines extending in the +Y and +Z directions. For the straight line extending in the +A direction, the +Y-directional end is closer to the −Z-side on the page of FIG. 2 than the −Y-directional end thereof is, as viewed from the +X direction. The directions orthogonal to the +A direction as viewed from the +X direction are defined as ±B directions. Hereinafter, the direction in which a paper sheet P is transported toward the alignment section 60 is defined as the +A direction, whereas the direction in which the paper sheet P is transported away from the alignment section 60 is defined as the −A direction. The +A direction is an example of a transport direction of a paper sheet P. Moreover, the direction in which the paper sheets P are stacked on the processing tray 42 is defined as the +B direction, whereas the direction opposite to the +B direction is defined as the −B direction.

The guide member 35, which forms a portion of the transport route TB, extends toward the processing tray 42. The press member 36 is disposed so as to be pivotable around a shaft 36A extending in the +X direction. The press member 36 presses a paper sheet P against the processing tray 42 (described later) by pushing a center PC (see FIG. 4) of the paper sheet P in the −B direction.

The flap 37 is disposed in substantially parallel with the alignment section 60 so as to be pivotable around the shaft 37A extending in the +X direction. The flap 37 presses a paper sheet P against the processing tray 42 by pushing a leading edge PF of the paper sheet P in the −B direction. The ejection roller 38 rotates to feed a paper sheet stack PT placed on the processing tray 42 to the ejection tray 33. The paper sheet stack PT is formed by the stapler 61 performing a stapling process on a plurality of paper sheets P stacked on the processing tray 42.

Figure 3:
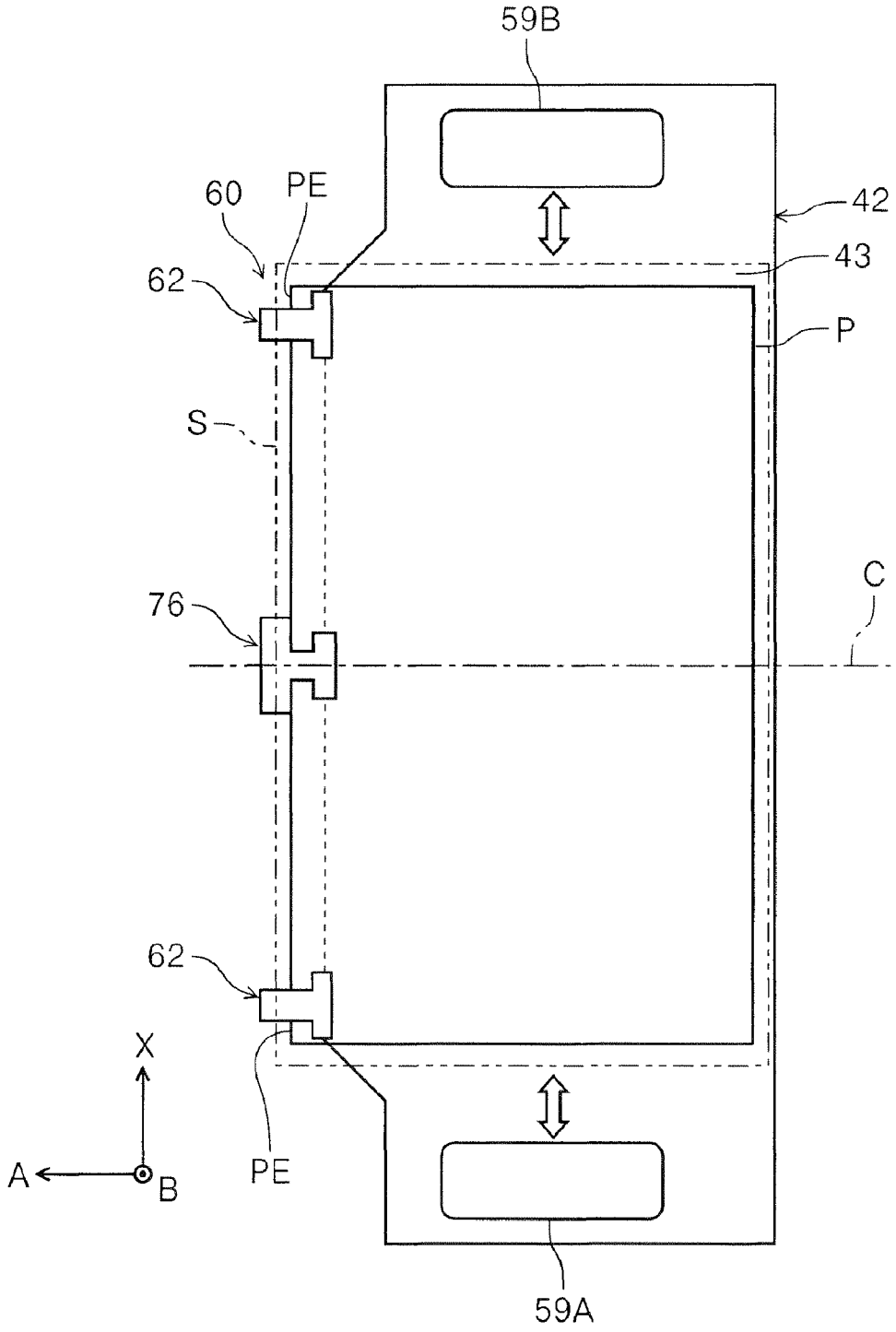
FIG. 3 is a plan view of the processing tray.

As illustrated in FIG. 3, the processing tray 42 is an example of a placement section to which a paper sheet P on which information has been recorded by the recording section 18 (see FIG. 1) is to be transported. On the processing tray 42, paper sheets P are stacked. The processing tray 42 may be formed of a flat plate having a predetermined thickness in the +B direction, with its length in the +X direction being greater than that of a paper sheet P in the +X direction. The processing tray 42 has a placement surface 43 on the +B-directional side, on which paper sheets P are to be placed. In this case, the placement surface 43 is substantially parallel to the A-X plane.

A placement area S is a virtual region that contains a portion of the processing tray 42 and some components disposed on the processing tray 42. The placement area S is substantially equal to the area of the maximum allowable size of paper sheets P to be placed on the processing tray 42. In short, the placement area S is formed on the surface of the processing tray 42. The placement area S is defined by the imaginary line in FIG. 3. A paper sheet P is transferred to the processing tray 42 and placed within the placement area S. In this case, the line that passes through the center of the placement area S in the +A direction is defined as a central line C.

As illustrated in FIG. 2, the transport section 44 transports a paper sheet P from the processing tray 42 to an alignment section 60 (described later). The transport section 44 includes a feed roller 46, a pair of first paddles 48, a first driver 52, a pair of second paddles 54, and a second driver 56, for example. The feed roller 46 rotates to feed a paper sheet P that has been transported along the guide member 35 to the processing tray 42.

The first paddles 48 are disposed so as to face, in the −B direction, an upstream portion of the processing tray 42 in the +A direction. The first paddles 48 share a rotational shaft 49 extending in the +X direction and each include three blades 51, for example. The blades 51, each of which may be a rectangular plate having a predetermined thickness in its rotational direction and made of a rubber material, are arranged with a predetermined spacing therebetween in the +X direction. The first paddles 48 transport a paper sheet P to the alignment section 60.

The first driver 52 includes a motor and a gear, both of which are not illustrated, and operates under the control of the above controller. The first driver 52 rotates the first paddles 48 to bring the blades 51 into contact with the paper sheet P, thereby transporting the paper sheet P to the alignment section 60 along the processing tray 42.

The second paddles 54 are disposed so as to face, in the −B direction, a downstream portion of the processing tray 42 in the +A direction. The second paddles 54 share a rotational shaft 55 extending in the +X direction and each include three blades 57, for example. The blades 57, each of which may be a rectangular plate having a predetermined thickness in its rotational direction and made of a rubber material, are arranged at a predetermined spacing therebetween in the +X direction. The second paddles 54 transport the paper sheet P to the alignment section 60.

The second driver 56 includes a motor and a gear, both of which are not illustrated and operates under the control of the controller. The second driver 56 rotates the second paddles 54 to bring the blades 57 into contact with the paper sheet P, thereby transporting the paper sheet P to the alignment section 60 along the processing tray 42.

The moving section 58 can move a plurality of paper sheets P stacked on the processing tray 42 in the ±X directions, which intersect the +A direction. The moving section 58 includes a first cursor 59A and a second cursor 59B (see FIG. 3), for example. Portions of the first cursor 59A and the second cursor 59B are movable in the ±X directions along the processing tray 42. Both of the first cursor 59A and the second cursor 59B may be driven by a driver (not illustrated) so that they can automatically move in the ±X directions. The first cursor 59A and the second cursor 59B align both the X-directional edges of a plurality of paper sheets P that have been stacked on the processing tray 42. More specifically, the first cursor 59A and the second cursor 59B move in the ±X directions while putting a paper sheet P or a paper sheet stack PT therebetween, thereby moving the paper sheet P or the paper sheet stack PT in the ±X directions.

The stapler 61 is an example of a processing section that processes a plurality of paper sheets P stacked on the processing tray 42. The stapler 61 is disposed downstream of the processing tray 42 in the +A direction. A portion of the stapler 61 is disposed in line with the alignment section 60 in the +X direction. More specifically, the stapler 61 may perform a stapling process by which a predetermined number of paper sheets P are fastened together and then ejects the paper sheet stack PT to the ejection tray 33. In addition to or instead of the stapling process, the stapler 61 may perform a punching process by which punch holes are formed in paper sheets P, a creasing process by which the paper sheets P are creased, a cutting process by which the paper sheets P are cut out, a folding process by which the paper sheets P are folded, and an attaching process by which the paper sheets P are attached together.

As illustrated in FIG. 3, the alignment section 60 includes two side alignment sections 62 and a center alignment section 76, for example. The center alignment section 76 is disposed on the +A-directional side of the processing tray 42. In addition, the center alignment section 76 is positioned on the central line C with its ±X-directional sides being symmetric to each other with respect to the central line C.

Both of the side alignment sections 62 are disposed on the +A-directional side of the processing tray 42 and arranged on the +X-directional and −X-directional sides, respectively, of the center alignment section 76. The side alignment sections 62 are positioned so as to be able to align corners PE, in the +X direction, of leading edges PF of a plurality of paper sheets P. The side alignment sections 62 are arranged symmetrically with respect to the central line C. Hereinafter, only one of the side alignment sections 62 will be mainly described, and the description of the other will be sometimes skipped. In this embodiment, the alignment refers to the alignment of the leading edges PF, in the +A direction, of paper sheets P that have been stacked in the +B direction.

Figure 4:
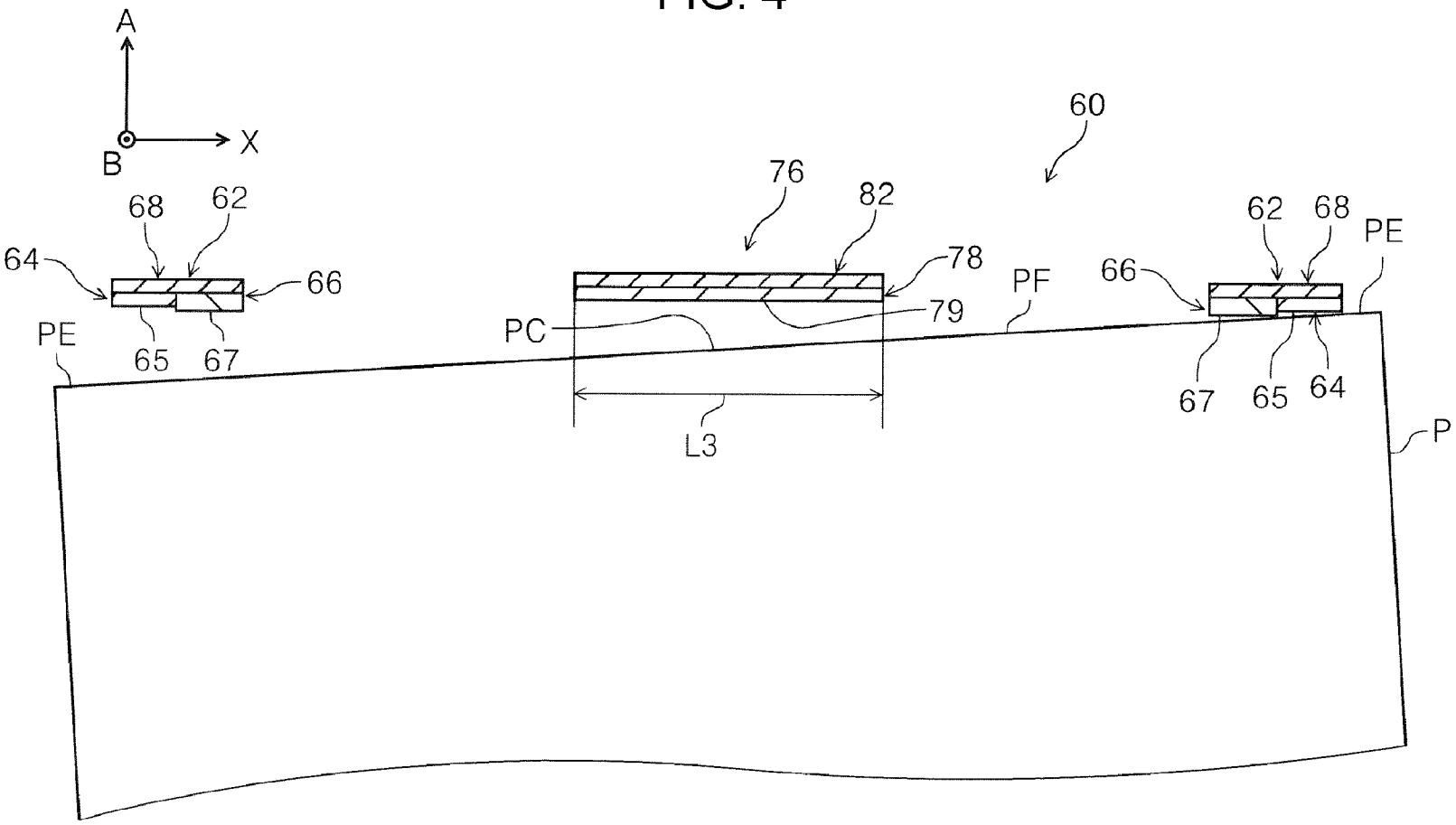
FIG. 4 schematically illustrates an angled paper sheet in contact with one first friction member in the postprocessing apparatus.

As illustrated in FIG. 4, each side alignment section 62 includes a first friction member 64, a second friction member 66, and a mounting member 68, for example. The first friction member 64 may be made of a corkboard having a predetermined thickness in the +A direction. The −A-directional side of the first friction member 64 is provided with a first alignment surface 65. In short, the first friction member 64 possesses the first alignment surface 65. The first alignment surface 65 is formed into a planar shape substantially parallel to the X-B plane and has a first friction coefficient μ1 for contact with a paper sheet P.

The second friction member 66 may be formed into a planar shape having a predetermined thickness in the +A direction. The second friction member 66 may be made of stainless steel. The second friction member 66 is thicker in the +A direction than the first friction member 64. The −A-directional side of the second friction member 66 is provided with a second alignment surface 67. In short, the second friction member 66 possesses the second alignment surface 67. The second alignment surface 67 is formed into a planar shape substantially parallel to the X-B plane and disposed on the second friction member 66 attached to the mounting member 68. The second alignment surface 67 has a second friction coefficient μ2 for contact with the paper sheet P, which is lower than the above first friction coefficient μ1.

Figure 5:
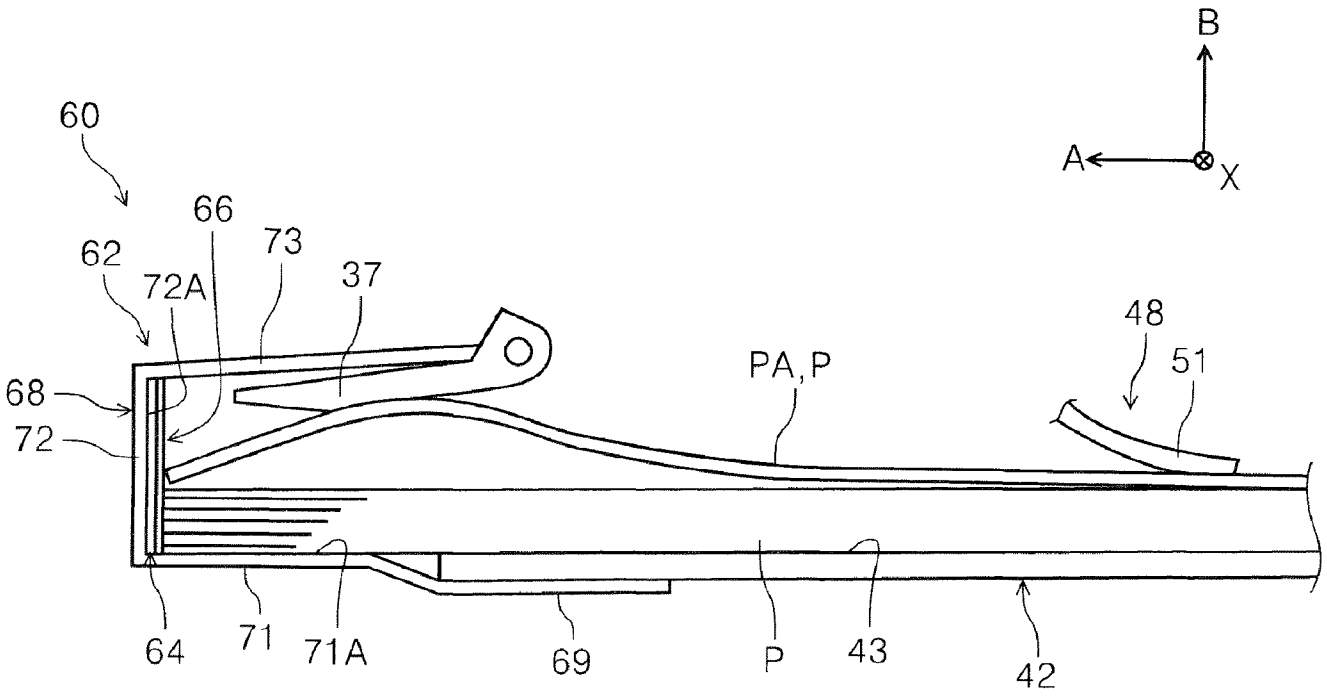
FIG. 5 schematically illustrates the paper sheets being aligned with one another on the processing tray.

As illustrated in FIG. 5, the mounting member 68 may be formed by bending a metal sheet several times. The mounting member 68 includes: a fixture 69 secured to the processing tray 42; a lower wall 71 extending from the fixture 69 in the +A direction; a vertical wall 72 extending from the lower wall 71 in the +B direction; and an upper wall 73 extending from the vertical wall 72 in the −A direction. The lower wall 71 has an upper surface 71A on the +B-directional side, which is disposed upstream of the placement surface 43 in the +A direction while being flush with the placement surface 43 in the +B direction. It should be noted that the illustration of the second paddles 54 (see FIG. 2) is omitted in FIG. 5.

The length of the vertical wall 72 in the +B direction is greater than the height of a maximum allowable number of paper sheets P to be stacked on the processing tray 42. Each pair of the first friction member 64 and the second friction member 66 is attached to a mounting surface 72A on the −A-directional side of the vertical wall 72 while being arranged side by side in the +X direction. Each pair of the first friction member 64 and the second friction member 66 may be attached with a double-sided tape.

Figure 6:
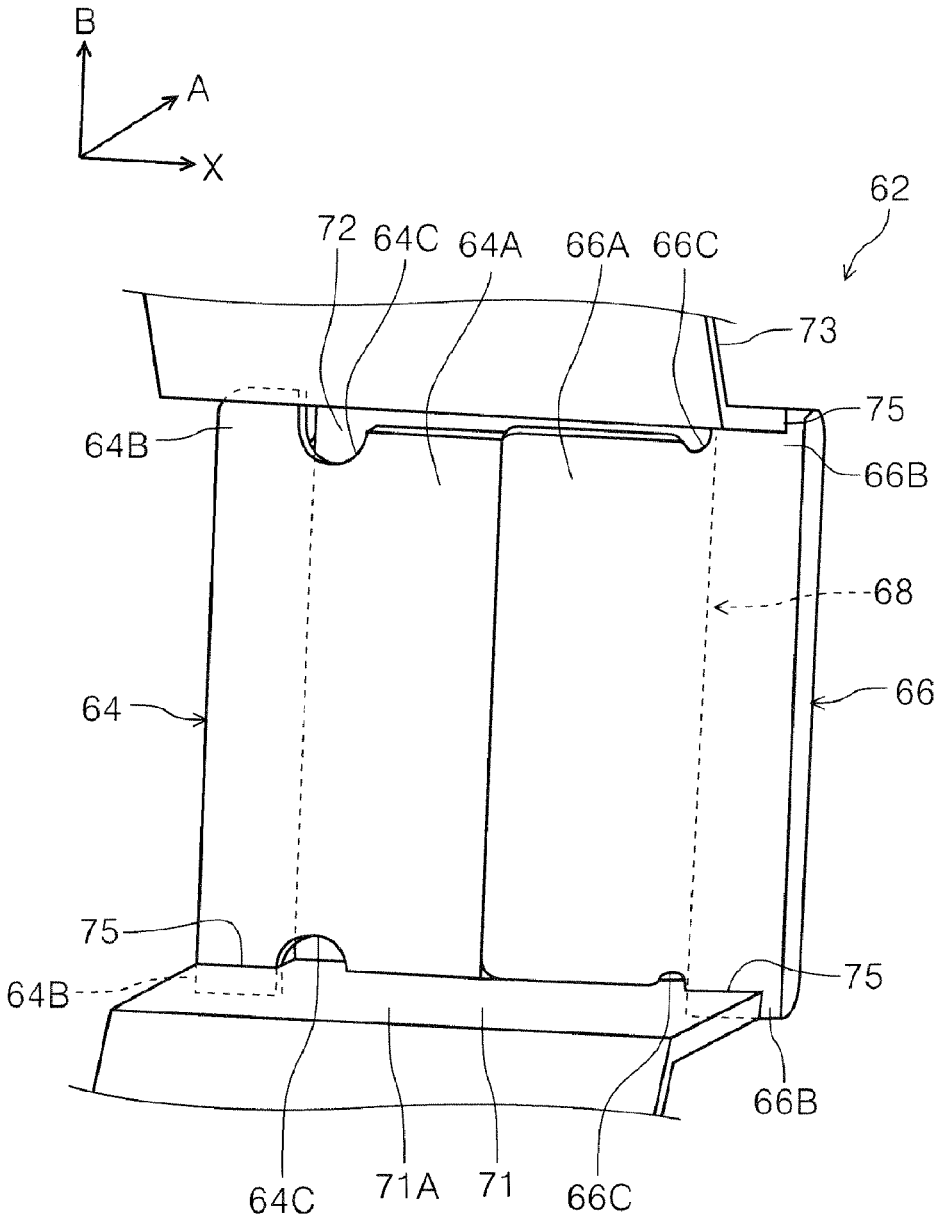
FIG. 6 schematically illustrates the first friction member and the second friction member mounted on a mounting member in the postprocessing apparatus.

As illustrated in FIG. 6, the vertical wall 72 may be shorter in the +X direction than the lower wall 71. The lower wall 71 has two notches 75 on its +A-directional side; the notches 75 are arranged on the ±X-directional ends. It should be noted that only the side alignment section 62 on the −X-directional side is illustrated in FIG. 6. Likewise, the upper wall 73 has two notches 75.

The first friction member 64 has a substantially H-shaped outline as viewed from the +A direction. The first friction member 64 includes: a base 64A attached to the vertical wall 72; two extension portions 64B extending from the base 64A; and two recess 64C, for example. The base 64A is formed into a rectangular shape with its length in the +B direction being greater than its length in the +X direction. The extension portions 64B are each formed into a sheet shape and extend in the +B directions, respectively, on the −X-directional side of the base 64A. The extension portions 64B are inserted into the corresponding notches 75 of the lower wall 71 and the upper wall 73.

The recesses 64C are formed in the first friction member 64 at respective locations where the ±B-directional sides of the base 64A are coupled to the +X-directional side surfaces of the extension portions 64B. Each recess 64C is formed into a semicircular shape as viewed from the +A direction. Each recess 64C serves as a clearance when the first friction member 64 is attached to the vertical wall 72. Forming the recesses 64C in this manner helps to attach the first friction member 64 to the vertical wall 72.

When the first friction member 64 is attached to the vertical wall 72, a gap may be created between the upper surface 71A and the −B-directional side of the portion of the base 64A which is positioned upstream of the recess 64C in the +X direction. In a comparative example in which the extension portion 64B is not formed, the leading edge PF (see FIG. 4) of a paper sheet P may be partly caught inside the gap. In this embodiment, however, the extension portion 64B extends so as to pass through the upper surface 71A in the −B direction, which blocks the leading edge PF of the paper sheet P from being caught inside the gap between the base 64A and the upper surface 71A. In short, this configuration reliably brings the leading edge PF of the paper sheet P into contact with the first friction member 64, thereby suppressing the leading edge PF from being caught inside the gap between the base 64A and the upper surface 71A. It should be noted that the extension portion 64B on the +B-directional side is effective likewise.

The second friction member 66 has a substantially H-shaped outline as viewed from the +A direction. The second friction member 66 includes: a base 66A attached to the vertical wall 72; two extension portions 66B extending from the base 66A; and two recess 66C, for example. The base 66A is formed with its length in the +B direction being greater than its length in the +X direction. The extension portions 66B are each formed into a sheet shape and extend in the +B directions, respectively, on the +X-directional side of the base 66A. The extension portions 66B are inserted into the corresponding notches 75 of the lower wall 71 and the upper wall 73.

The recesses 66C are formed in the second friction member 66 at respective locations where the ±B-directional sides of the base 66A are coupled to the −X-directional side surfaces of the extension portions 66B. Each recess 66C is formed into a semicircular shape as viewed from the +A direction. Each recess 66C serves as a clearance when the second friction member 66 is attached to the vertical wall 72. Forming the recesses 66C in this manner helps to attach the second friction member 66 to the vertical wall 72. The extension portions 66B produce substantially the same effect as the extension portion 64B, more specifically suppresses the leading edge PF of a paper sheet P from being caught inside the gap. Thus, details of the effects of the extension portion 66B will not be described. In this embodiment, the recesses 64C are formed larger than the recesses 66C due to a difference in formability.

Figure 7:
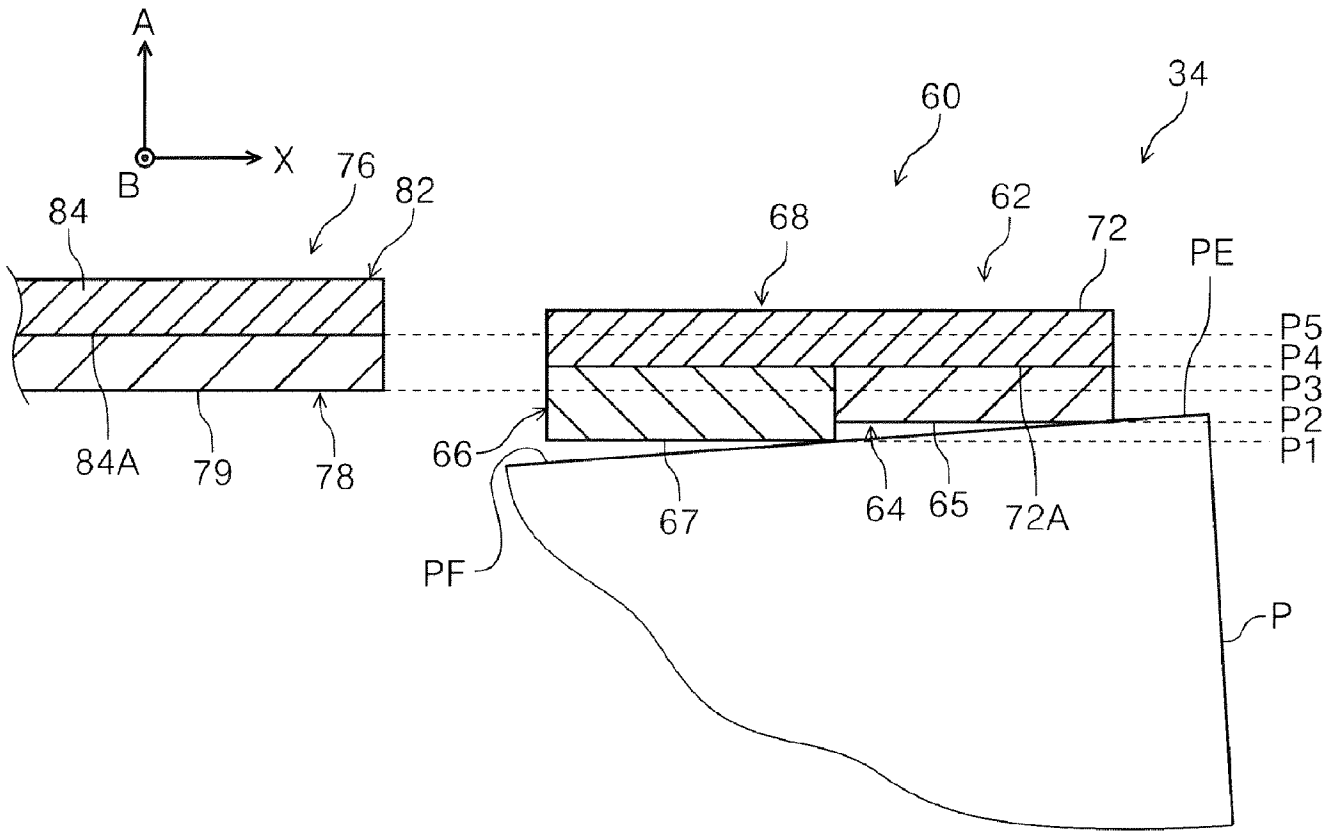
FIG. 7 schematically illustrates the positional relationship of some members in the postprocessing apparatus in the transport direction of a paper sheet.

FIG. 7 illustrates locations, in the +A direction, of the respective surfaces of a side alignment section 62 and the center alignment section 76 arranged side by side in the X direction. The center alignment section 76 includes a third friction member 78 and a mounting member 82, for example. The third friction member 78 may be made of a planar corkboard having a predetermined thickness in the +A direction. The third friction member 78 has a third alignment surface 79 on the −A-directional side, which is formed into a planer shape substantially parallel to the X-B plane. The third alignment surface 79 has a third friction coefficient $\mu 3$ for contact with a paper sheet P, which is higher than the second friction coefficient $\mu 2$ and may be substantially the same as the first friction coefficient $\mu 1$.

The mounting member 82 may be formed by bending a metal sheet several times so that its length in the +X direction becomes greater than the length of the mounting member 68 in the +X direction. The mounting member 82 has substantially the same dimensions as the mounting member 68 as viewed from the +X direction and is partly secured to the processing tray 42 (see FIG. 2). The mounting member 82 has a vertical wall 84 extending in the +B direction. The vertical wall 84 may be formed into a planar shape having a predetermined thickness in the +A direction. The third friction member 78 is attached to a mounting surface 84A formed on the −A-directional side of the vertical wall 84 with a double-sided tape, for example.

Figure 8:
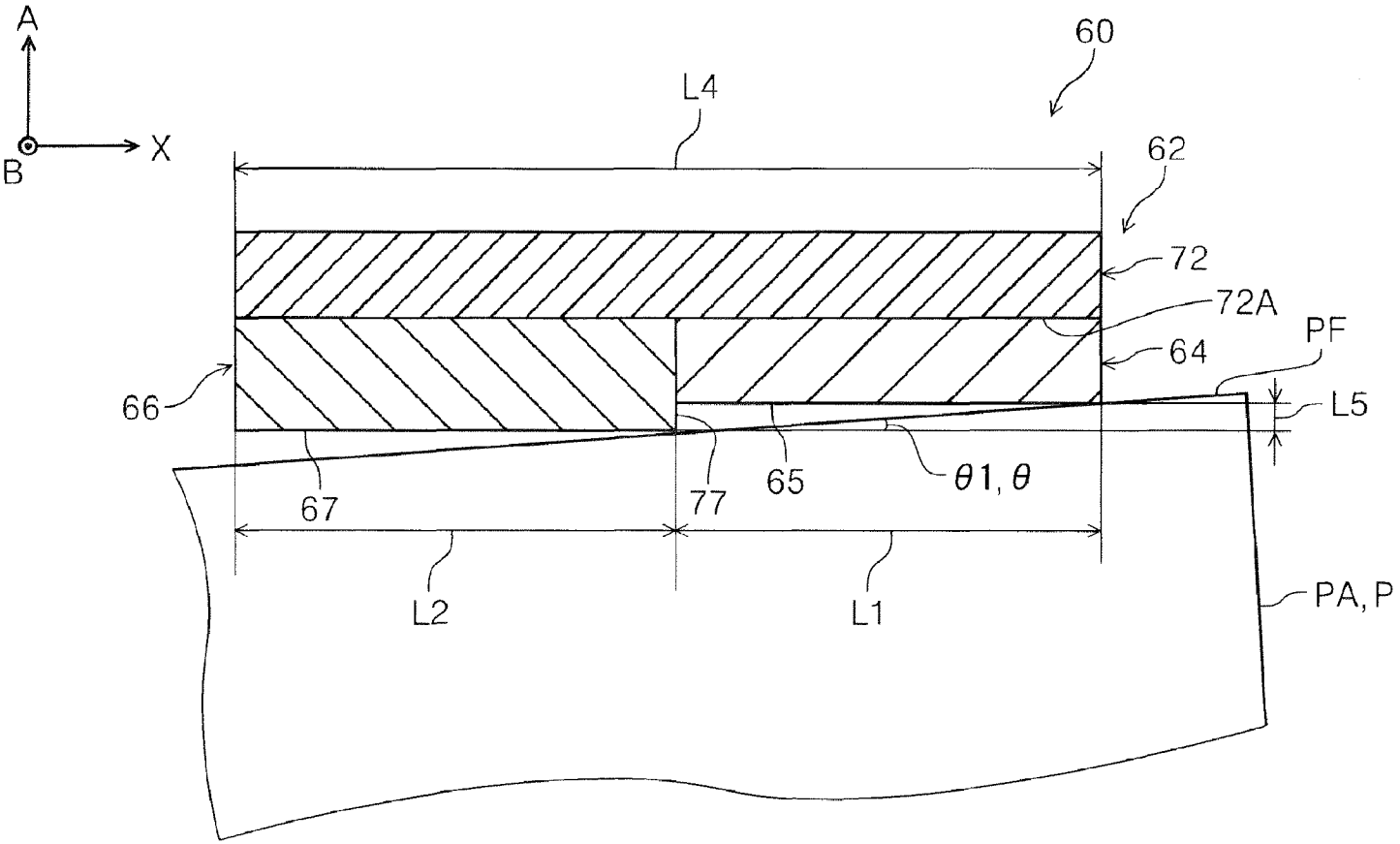
FIG. 8 is a schematic, enlarged view of a first friction member and a second friction member in the postprocessing apparatus.

As illustrated in FIGS. 4, 7, and 8, $L1 \approx L2$ is satisfied, where L1 denotes the length (mm) of the first alignment surface 65 in the +X direction, and L2 denotes the length (mm) of the second alignment surface 67 in the +X direction. In addition, $L3 > L1$ and $L3 > L2$ are satisfied, where L3 denotes the length (mm) of the third alignment surface 79 in the +X direction. The first alignment surface 65 is disposed upstream of the third alignment surface 79 in the +A direction. The second alignment surface 67 is disposed upstream of the first alignment surface 65 in the +A direction and closer to the center of the placement area S (see FIG. 3) in the +X direction than the first alignment surface 65 is. The third alignment surface 79 is disposed closer to the center in the +X direction than the second alignment surface 67 is and downstream of the second alignment surface 67 in the +A direction.

As described above, the alignment section 60 includes two first alignment surfaces 65 and two second alignment surfaces 67, for example. The first alignment surfaces 65 are arranged on the ±X-directional sides, respectively, of the placement area S so as to be symmetric to each other with respect to the central line C (see FIG. 3). Likewise, the second alignment surfaces 67 are arranged on the ±X-directional sides, respectively, of the placement area S so as to be symmetric to each other with respect to the central line C.

As illustrated in FIG. 7, the location of the second alignment surface 67 in the +A direction is denoted by P1; the location of the first alignment surface 65 in the +A direction is denoted by P2; the location of the third alignment surface 79 in the +A direction is denoted by P3; the location of the mounting surface 72A in the +A direction is denoted by P4; and the location of the mounting surface 84A in the +A direction is denoted by P5. In this case, the locations P1, P2, P3, P4, and P5 may be arranged in this order from the upstream side in the +A direction. However, the distances between the locations P1, P2, P3, P4, and P5 may be different from one another in the +A direction.

As illustrated in FIG. 8, $L4 = L1 + L2$ may be satisfied, where L4 denotes the length (mm) of the vertical wall 72 in the +X direction. The −X-directional side surface of the first friction member 64 may be in contact with the +X-directional side surface of the second friction member 66, with the first alignment surface 65 being shifted from the second alignment surface 67 as viewed from the +A direction, namely, with a step 77 being formed between the first friction member 64 and the second friction member 66. The cross-section of each of the first friction member 64 and the second friction member 66 taken along the X-A plane has a rectangular shape with its length in the +X direction being greater than its length in the +A direction. Furthermore, the downstream edge of the paper sheet P in the +A direction corresponds to the leading edge PF; the angle between the leading edge PF and the X-axis is defined as an angle $\theta$ (deg).

Suppose the uppermost one of a plurality of paper sheets P stacked on the processing tray 42 (see FIG. 3) is transported to the alignment section 60 inside the space where neither the first alignment surfaces 65 nor the second alignment surfaces 67 is present. In this case, the uppermost paper sheet P forms an angle $\theta = \theta 1$ (deg) with the X-axis, and the length of the first alignment surface 65 in the +X direction is the length L1. Hereinafter, the expression "the movement of the uppermost paper sheet P into the space between the other paper sheets P and the alignment section 60" is referred to as the unexpected entry of the paper sheet P.

The amount by which the second alignment surface 67 is shifted from the first alignment surface 65 in the +A direction is defined as a length L5 (mm), which can be expressed as $L5 = (L1) \times \tan \theta 1$. When the paper sheet P comes into contact with a pair of a first friction member 64 and a second friction member 66 while forming the angle $\theta 1$ with the X-axis, the arrangement of the first friction member 64 and the second friction member 66 act to decrease the angle θ1. This configuration is effective in suppressing the unexpected entry of the paper sheet P.

Figure 9:
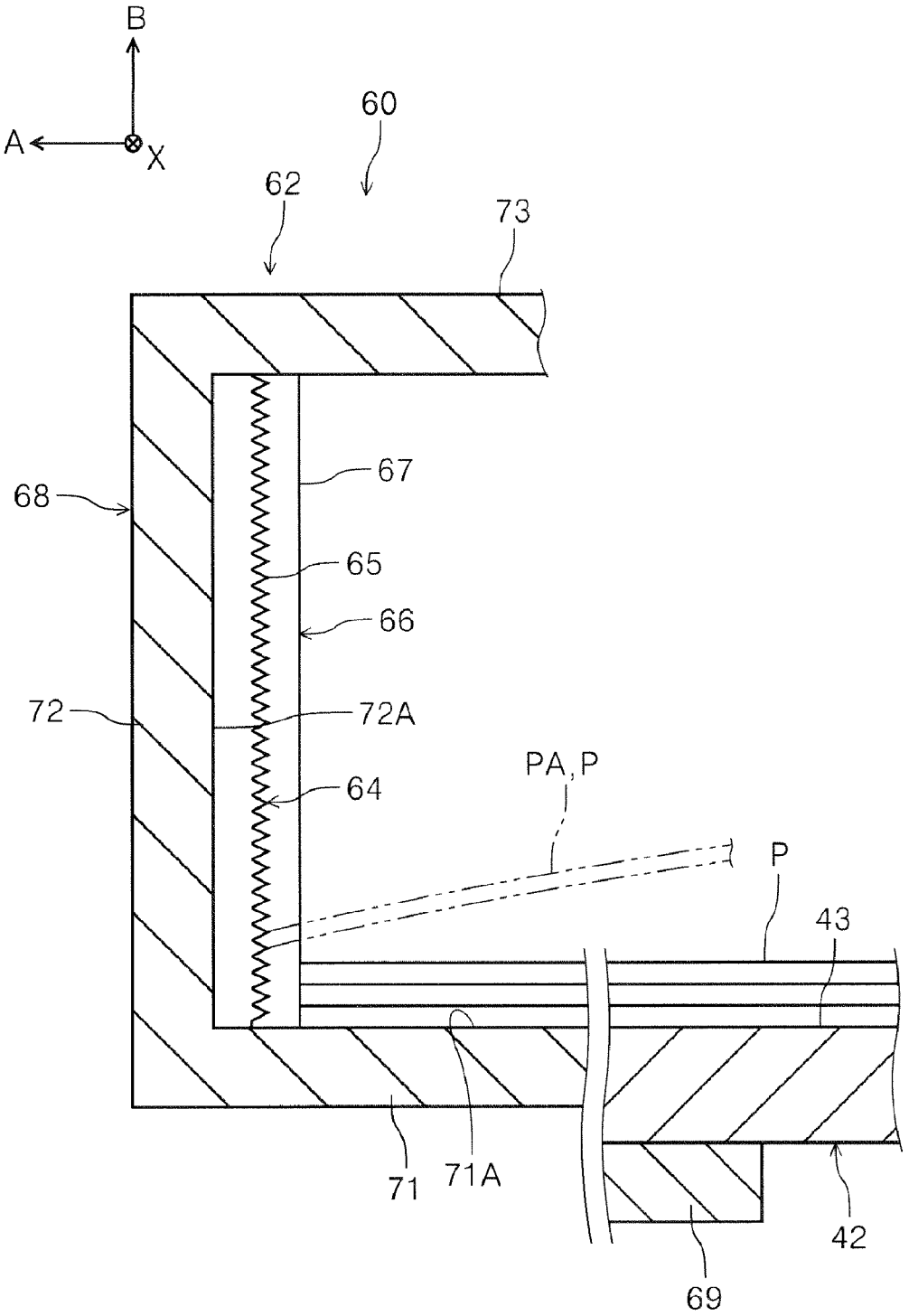
FIG. 9 schematically illustrates paper sheets, the leading edges of which are in contact with the first friction member in the postprocessing apparatus.

As illustrated in FIG. 9, the first alignment surface 65 may have uniform surface roughness in the +B direction. In other words, the first friction coefficient μ1 of the first alignment surface 65 is entirely higher than the second friction coefficient μ2 of the second alignment surface 67 in the +B direction.

Next, a description will be given below of functions and effects of the stacking unit 34 and the postprocessing apparatus 30 in the record system 1 according to the first embodiment. When some components of the record system 1 which have already been explained are described again, the numbers of the figures to be referenced will not be described.

Figure 10:
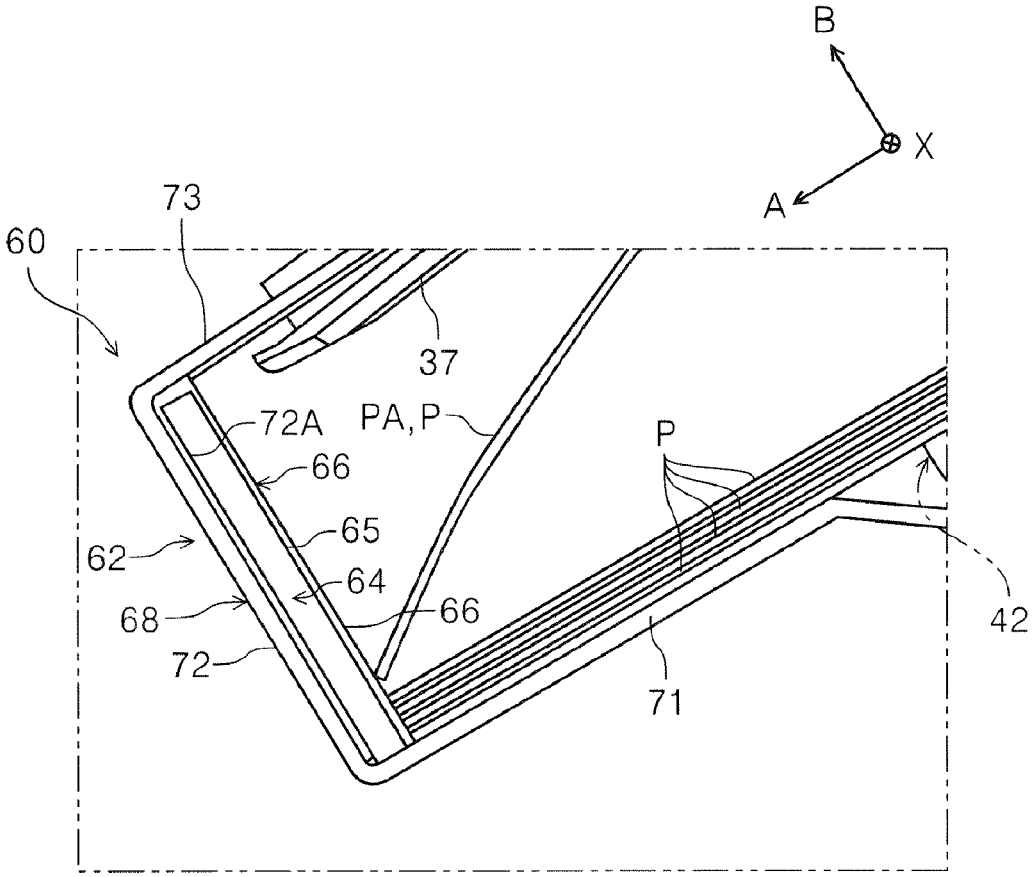
FIG. 10 schematically illustrates the paper sheets, the leading edges of which are in contact with the first friction member in the postprocessing apparatus.

With reference to FIG. 10, a description will be given below regarding a case where the transport section 44 (see FIG. 2) transports the uppermost one of a plurality of paper sheets P stacked on both the processing tray 42 and the lower wall 71 to the alignment section 60. In FIG. 10, only one side alignment section 62 is illustrated, and the illustration of the center alignment section 76 (see FIG. 3) is omitted.

When the paper sheet P on which information has been recorded with a relatively small amount of ink Q is transported by the transport section 44, the paper sheet P is less likely to greatly swell because the amount of ink Q impregnated in the paper sheet P is small. In this case, the paper sheet P does not curl and can maintain its stiffness against external force given in the +A direction. As a result, there is a low possibility that the unexpected entry of the paper sheet P occurs.

When the paper sheet P on which information has been recorded with a relatively large amount of ink Q is transported by the transport section 44, the paper sheet P is likely to greatly swell because the amount of ink Q impregnated in the paper sheet P is large. In this case, the paper sheet P may curl and fail to maintain its stiffness against external force applied in the +A direction. As a result, the angle θ that the leading edge PF of the paper sheet P being transported to the alignment section 60 forms with the X-axis might increase.

When the paper sheet P reaches the alignment section 60 while angled with respect to the X-axis, a portion of the leading edge PF of the paper sheet P in the +A direction comes into contact with the first alignment surface 65 of the first friction member 64. Then, when the leading edge PF of the paper sheet P moves in the −B direction, the first alignment surface 65 having the first friction coefficient μ1 applies a relatively large friction force to the paper sheet P in the +B direction. This configuration suppresses the leading edge PF of the paper sheet P from unexpectedly entering into the space between the alignment section 60 and the leading edges PF of the other paper sheets P that have already been stacked.

When the uppermost paper sheet P is further transported, another portion of the leading edge PF of the paper sheet P reaches the alignment section 60. In this case, the portion of the leading edge PF of the paper sheet P which has already reached the alignment section 60 is curled. However, after the paper sheet P has been transported away from the rotating first paddles 48 and second paddles 54, the feeding force acting on the paper sheet P is released. As a result, the curled portion of the paper sheet P which has already reached the alignment section 60 becomes straight, so that the leading edge PF of the paper sheet P becomes aligned with the X-axis. After that, the paper sheet P is subjected to the stapling process by the stapler 61 together with other paper sheets P. In this way, the paper sheet stack PT is formed.

Figure 11:
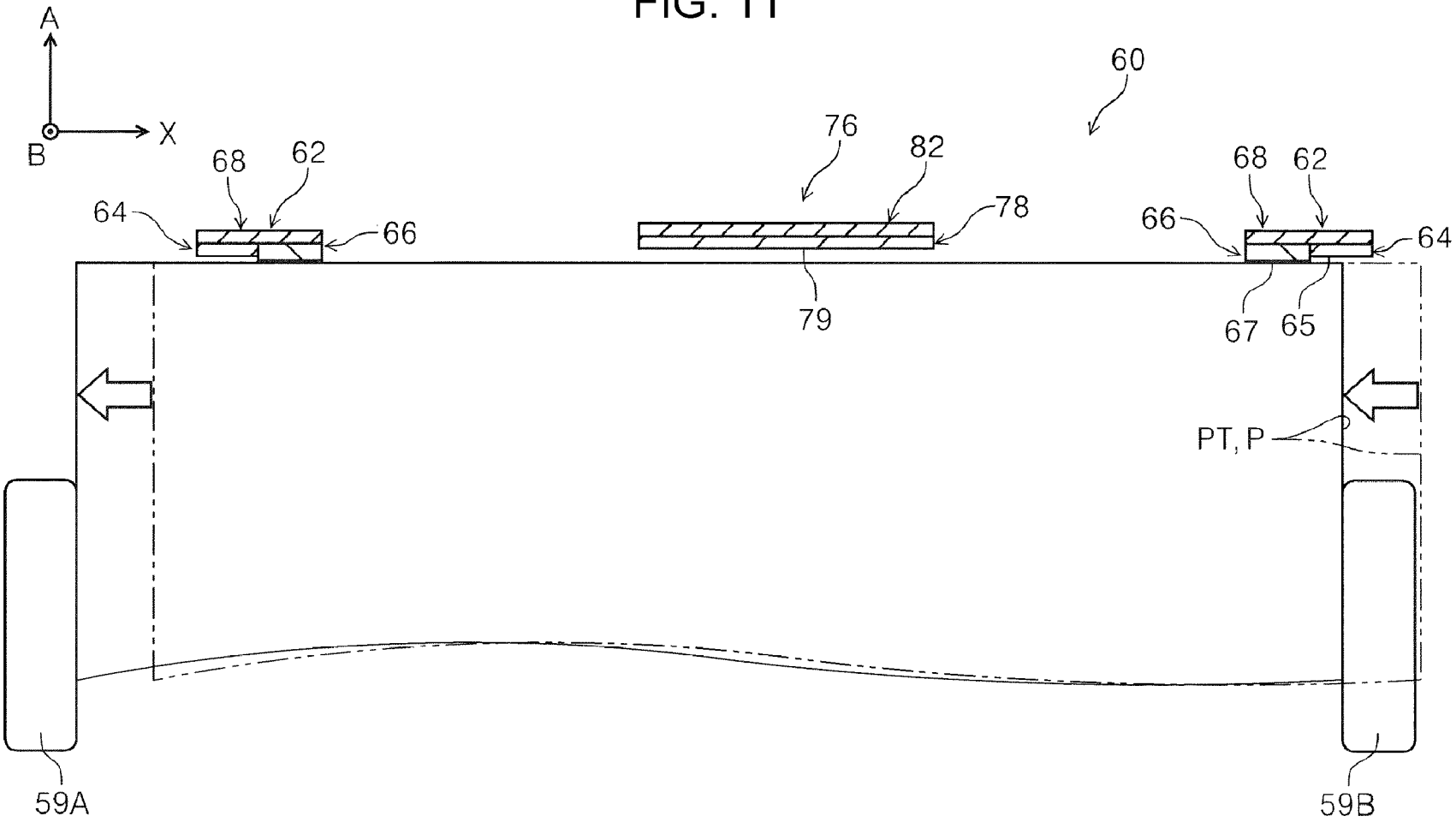
FIG. 11 schematically illustrates a paper sheet being moved in a width direction of the postprocessing apparatus.

As illustrated in FIG. 11, the paper sheet stack PT is placed between the first cursor 59A and the second cursor 59B while all of them are aligned together in the +X direction. When both the first cursor 59A and the second cursor 59B move in the −X direction, the paper sheet stack PT also moves in the −X direction.

Figure 12:
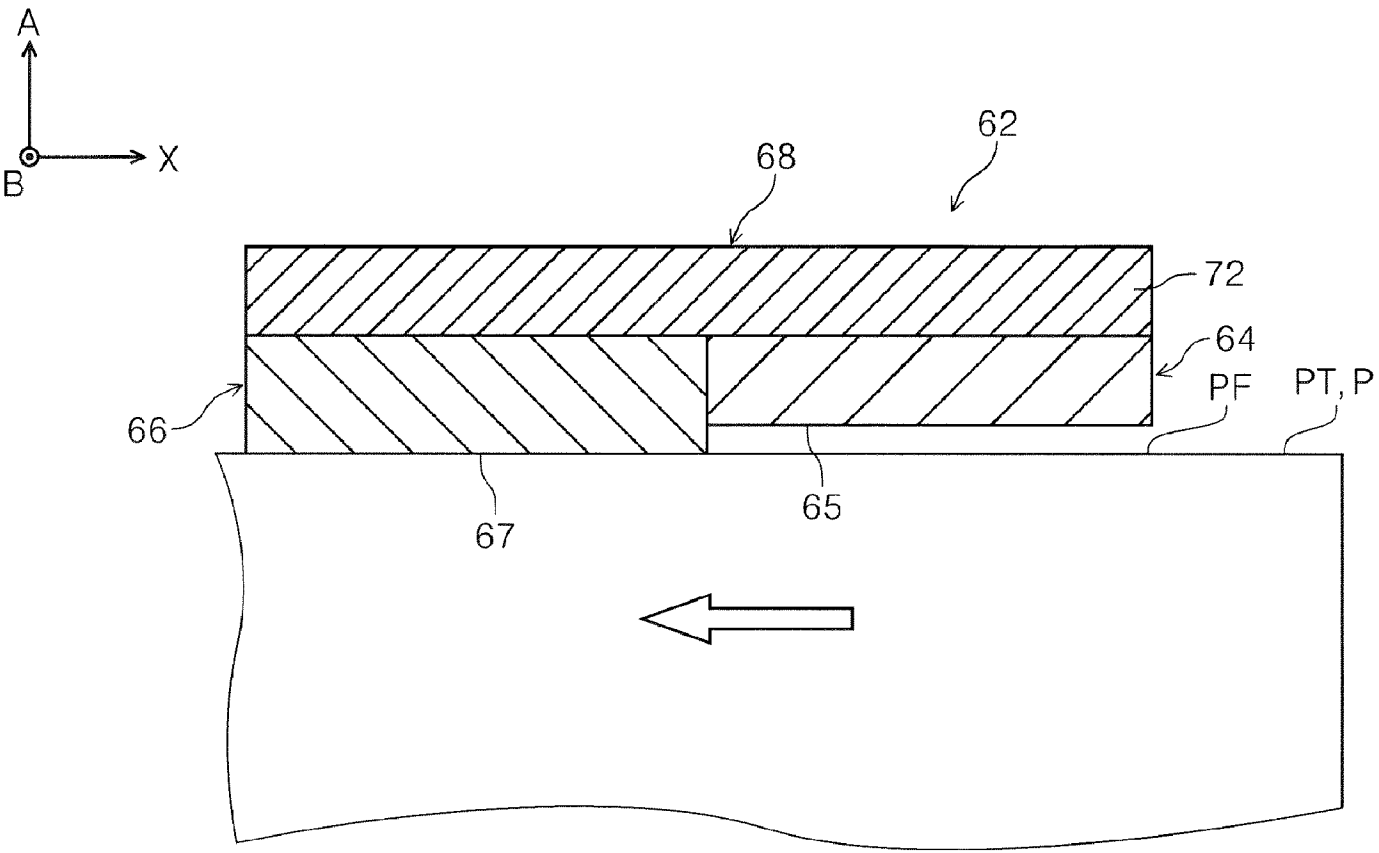
FIG. 12 schematically illustrates a paper sheet, the leading edge of which is in contact with the second friction member in the postprocessing apparatus.

While the paper sheet stack PT is being moved in the −X direction as illustrated in FIG. 12, a leading edge PF of the paper sheet stack PT is kept in contact with the second alignment surface 67 but apart from the first alignment surface 65 because the second alignment surface 67 is shifted from the first alignment surface 65 as viewed from the +B direction. Thus, when the paper sheet stack PT is moved in the −X direction, this movement is not prohibited by the first friction member 64 because the first friction member 64 does not generate a relatively large friction force. It should be noted that, when the paper sheet stack PT is moved in the +X direction, the same effect is produced.

Suppose an uppermost one (referred to below as the uppermost paper sheet PA) of a plurality of paper sheets P stacked on the processing tray 42 is transported to the alignment section 60 over the paper sheets P, as described above. Further, the uppermost paper sheet PA is warped. According to the stacking unit 34 in the first embodiment, when transported to the alignment section 60 by the transport section 44, the uppermost paper sheet PA may be angled with respect to a straight lines extending in the +A or +X direction. Following this, a portion of the downstream, leading edge PF of the angled uppermost paper sheet PA might come into contact with a first alignment surface 65 and then unexpectedly move toward the processing tray 42. In this case, however, the first alignment surface 65, the first friction coefficient μ1 of which is higher than the second friction coefficient μ2 of the second alignment surface 67, applies a relatively large friction force to the portion of the leading edge PF in the direction opposite to the moving direction. Therefore, this configuration can suppress the portion of the downstream, leading edge PF from entering into the space between the alignment section 60 and the leading edges PF of the paper sheets P that have already been stacked.

When the uppermost paper sheet PA is further transported, the portion of the leading edge PF of the uppermost paper sheet PA is curled, and another portion of the leading edge PF reaches substantially the same location as this curled portion in the +A direction. Then, the pressing force that the transport section 44 has applied to the uppermost paper sheet PA is released so that the angle of the uppermost paper sheet PA is corrected. In this case, the other portion of the leading edge PF is in contact with the second alignment surface 67. Since the second alignment surface 67 is positioned upstream of the first alignment surface 65 in the +A direction, the leading edge PF of the uppermost paper sheet PA comes off the first alignment surface 65 and, in turn, comes into contact with the second alignment surface 67 during the correction of the angle of the uppermost paper sheet PA. As a result, portions of the leading edges PF of the paper sheets P, including the uppermost paper sheet PA, stacked on the processing tray 42 come into contact with the second alignment surface 67.

When the moving section 58 moves the plurality of paper sheets P including the uppermost paper sheet PA in the +X or −X direction, the second alignment surface 67, the second friction coefficient μ2 of which is lower than the first friction coefficient μ1 of the first friction member 64, applies a relatively small friction force to the leading edges PF of the paper sheets P in the direction opposite to the moving direction. Thus, the moving section 58 can move the paper sheets P in the ±X directions with only a light load placed on the paper sheets P. Furthermore, the stacking unit 34 can be formed with a simple configuration because it is unnecessary to move the first alignment surfaces 65 or the second alignment surfaces 67.

According to the stacking unit 34, when the paper sheet P is further transferred in the +A direction after the leading edge PF of the paper sheet P has come into the second alignment surface 67, the center PC, in the +X direction, of the leading edge PF of the paper sheet P comes into contact with the third alignment surface 79. In this case, even if the leading edge PF of the paper sheet P moves toward the processing tray 42, the third alignment surface 79, the third friction coefficient μ3 which is higher than the second friction coefficient μ2 of the second alignment surface 67, applies a relatively large friction force to the center PC of the leading edge PF of the paper sheet P in the direction opposite to the moving direction. Therefore, this configuration can suppress the leading edge PF of the paper sheet P from entering into the space between the third alignment surface 79 and the leading edges PF of the paper sheets P that have already been stacked. Moreover, since the third alignment surface 79 is disposed downstream of the second alignment surfaces 67 in the +A direction, the paper sheets P come into contact with the third alignment surface 79 less frequently than the second alignment surfaces 67. Therefore, the moving section 58 can move the plurality of paper sheets P in the ±X directions under only a light load.

When a paper sheet P is angled with respect to a straight line extending in the +A direction, one corner PE of the leading edge PF of the paper sheet P is transported ahead of the other corner PE thereof and is positioned downstream of the center PC of the leading edge PF of the paper sheet P in the +A direction. In other words, the downstream corner PE of the leading edge PF of the angled paper sheet P is positioned ahead of the center PC thereof in the +A direction. According to the stacking unit 34, the first alignment surfaces 65 are positioned upstream of the third alignment surface 79 in the +A direction. The downstream corner PE of the leading edge PF of the paper sheet P thus comes into contact with the first alignment surface 65 having a relatively high friction coefficient earlier than when the center PC thereof comes into contact with the third alignment surface 79 having a relatively low friction coefficient. This configuration can suppress the paper sheet P from entering into the space between the first alignment surface 65 and the leading edges PF of paper sheets P that have already been stacked. Moreover, when the moving section 58 moves the plurality of paper sheets P in the +X or −X direction after the angle of the paper sheet P has been corrected by bringing the leading edge PF into contact with the first alignment surface 65, these paper sheets P come into contact with the second alignment surface 67 having a relatively low friction coefficient. Therefore, the moving section 58 can move the paper sheets P in the ±X directions under only a light load.

According to the stacking unit 34, even when the paper sheet P being transferred to the alignment section 60 is angled, the leading edge PF of the paper sheet P can reliably come into contact with the first alignment surface 65 and the second alignment surface 67 in this order, independently of its angled orientation, more specifically regardless of which corner PE, in the +X direction, of the leading edge PF of the paper sheet P is positioned ahead. Moreover, according to the stacking unit 34, the first friction coefficient μ1 of the first alignment surface 65 is higher than the second friction coefficient μ2 of the second alignment surface 67 at least in the +B direction. It is thus possible to suppress the downstream, leading edge PF of the paper sheet P from entering into the space between the alignment section 60 and the leading edge PF of the paper sheets P that have already been stacked on the processing tray 42. Therefore, the paper sheet P being transported to the processing tray 42 does not affect the alignment of the leading edges PF of the paper sheets P that has already been stacked.

According to the stacking unit 34, the first friction members 64 provided with the respective first alignment surfaces 65 are replaceable. Thus, when one of the first alignment surfaces 65 is worn out, it is only necessary to replace the corresponding first friction member 64 without replacing the entire alignment section 60. It is consequently possible to avoid discarding many components in the process of replacing the first alignment surfaces 65. Likewise, according to the stacking unit 34, the second friction members 66 provided with the second alignment surfaces 67 are replaceable. Thus, when one of the second alignment surfaces 67 is worn out, it is only necessary to replace the corresponding second friction member 66 without replacing the entire alignment section 60. It is consequently possible to avoid discarding many components in the process of replacing the second alignment surface 67.

According to the postprocessing apparatus 30, the moving section 58 can move the plurality of paper sheets P in the ±X directions with only a light load placed on the paper sheets P, thereby reducing the risk of the paper sheets P being distorted.

Second Embodiment

Next, a description will be given below of a record system 1, a postprocessing apparatus 30, and a stacking unit 90 according to a second embodiment with reference to some accompanying drawings. A stacking unit 90 in the second embodiment differs from the stacking unit 34 (see FIG. 7) in the foregoing first embodiment, in the positional relationship between a first alignment surface 65 and a third alignment surface 79. Other components in the second embodiment are substantially the same as those in the first embodiment. Those components are given the identical reference numbers and will be described with reference to the FIGS. 1 to 12.

Figure 13:
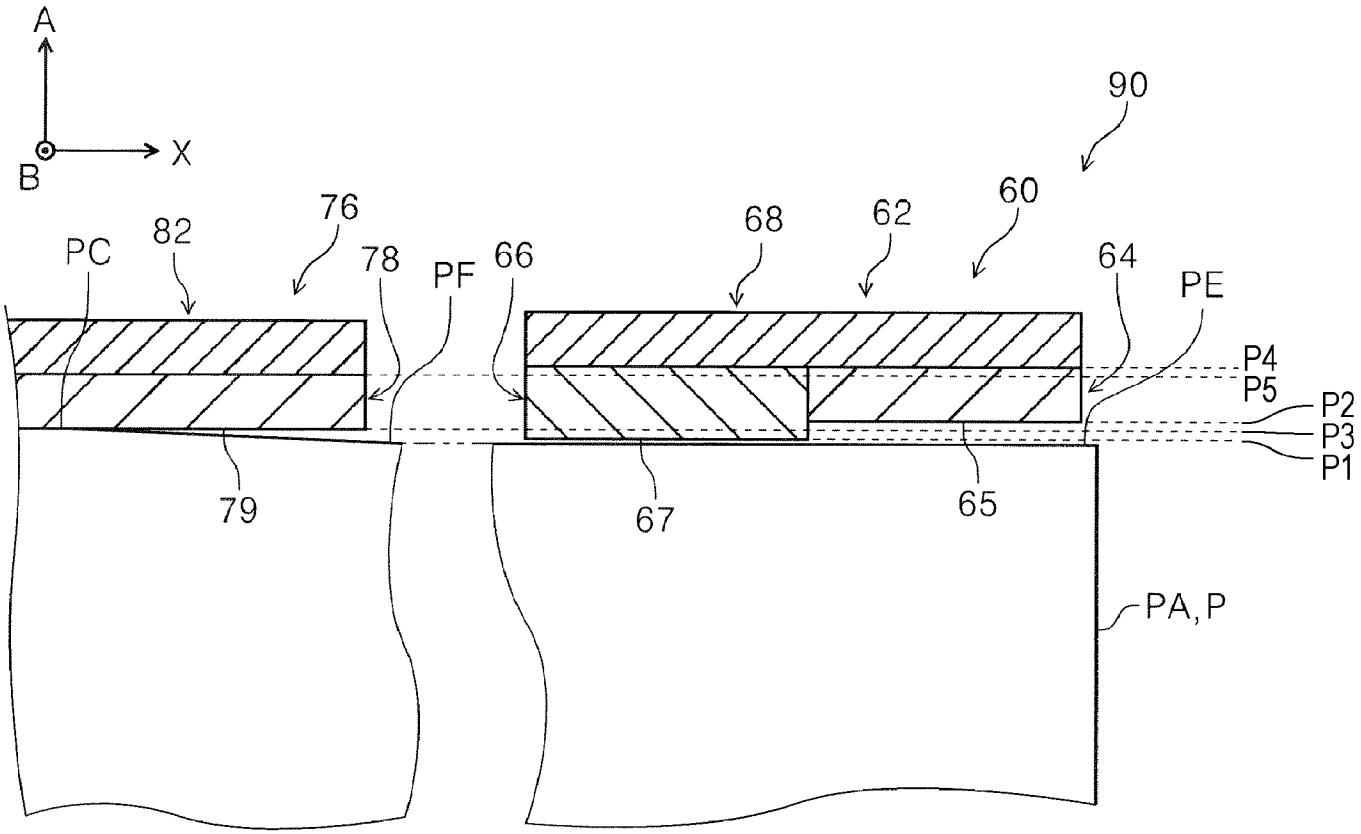
FIG. 13 schematically illustrates the positional relationship, in the transport direction, of some members in the postprocessing apparatus according to a second embodiment of the present disclosure.

In the second embodiment, as illustrated in FIG. 13, the third alignment surface 79 is disposed upstream of the first alignment surface 65 in the +A direction. More specifically, locations P1, P3, P2, P5, and P4, which correspond to those described in the first embodiment (see FIG. 7), are arranged in this order from the upstream side in the +A direction.

A function and effect of the stacking unit 90 in the second embodiment will be described below. However, functions and effects of the record system 1 and the postprocessing apparatus 30 in the second embodiment will not be described below because they are substantially the same as those in the first embodiment. When a paper sheet P being transferred toward an alignment section 60 is not angled or is slightly angled, a center PC of the leading edge PF of the paper sheet P in the +X direction may be positioned downstream of a corner PE thereof in the +A direction after a leading edge PF of the paper sheet P in the +A direction has come into contact into a second alignment surface 67. According to the stacking unit 90 in the second embodiment, the third alignment surface 79 is positioned upstream of the first alignment surface 65 in the +A direction. The center PC of the leading edge PF of the paper sheet P being transported ahead of the corner PE thus comes into contact with the third alignment surface 79 having a relatively high friction coefficient earlier than the corner PE does. This configuration can suppress the paper sheet P from entering into the space between the third alignment surface 79 and leading edges PF of paper sheets P that have already been stacked. Moreover, when a moving section 58 (see FIG. 2) moves the plurality of paper sheets P in the +X or −X direction after the angle of the paper sheet P has been corrected by bringing the leading edge PF of the paper sheet P into contact with the third alignment surface 79, the paper sheets P come into contact with the second alignment surface 67 having a relatively low friction coefficient. As a result, the moving section 58 can move the paper sheets P under only a light load.

Third Embodiment

Next, a description will be given below of a record system 1, a postprocessing apparatus 30, and a stacking unit 94 according to a third embodiment with reference to some accompanying drawings. A stacking unit 94 in the third embodiment differs from the stacking unit 34 in the foregoing first embodiment because the stacking unit 94 is provided with a side alignment section 96 instead of the side alignment section 62 (see FIG. 7). Other components in the third embodiment are substantially the same as those in the first embodiment. Those components are given the identical reference numbers and will be described with reference to the FIGS. 1 to 12.

Figure 14:
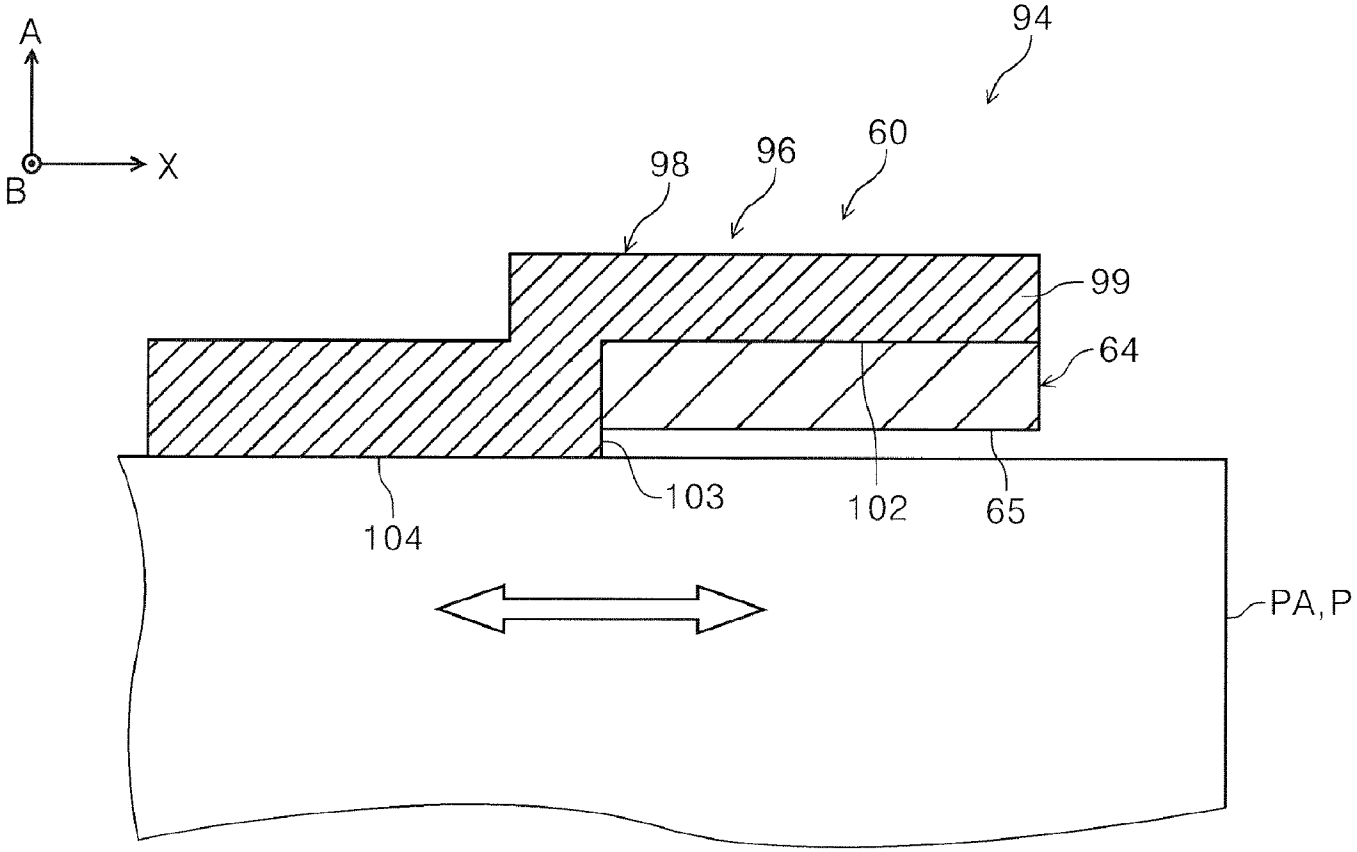
FIG. 14 schematically illustrates a paper sheet, the leading edge of which is in contact with the second alignment surface of a mounting member in the postprocessing apparatus according to a third embodiment of the present disclosure.

As illustrated in FIG. 14, the side alignment section 96 in the third embodiment includes a first friction member 64 and a mounting member 98, for example. It should be noted that only the side alignment section 96 disposed on the +X-directional side will be illustrated and described below, and the illustration and description of the side alignment section 96 disposed on the opposite side are omitted. The mounting member 98 may be formed by bending a stainless steel plate several times. The mounting member 98 includes a vertical wall 99, which corresponds to the vertical wall 72 (see FIG. 7) of the mounting member 68. Other components of the mounting member 98 are substantially the same as those of the mounting member 68.

The vertical wall 99 is curved at right angles at two points as viewed from the +B direction. The vertical wall 99 includes a mounting surface 102, a side surface 103, and a second alignment surface 104. In short, the second alignment surface 104 is formed on the mounting member 98. The mounting surface 102, which is substantially parallel to the X-B plane, may be attached to the first friction member 64 with a double-sided tape (not illustrated); the side surface 103 extends in the −A direction from the −X-directional side of the mounting surface 102. The second alignment surface 104, which is substantially parallel to the X-B plane, extends in the −X direction from the −A-directional side of the side surface 103. The second alignment surface 104 has a second friction coefficient $\mu 2$ for contact with a paper sheet P.

A function and effect of the stacking unit 94 in the third embodiment will be described below. However, functions and effects of a record system 1 and a postprocessing apparatus 30 in the third embodiment will not be described below because they are substantially the same as those in the first embodiment. According to the stacking unit 94, the second alignment surface 104 is formed on the mounting member 98. Therefore, the stacking unit 94 can be fabricated without performing a process of attaching a member provided with the second alignment surface 104 to the mounting member 98.

Examples of the medium stacking apparatuses and the postprocessing apparatuses according to the first to third embodiments of the present disclosure basically include the components described above. However, it is obvious that some of those components can be modified, replaced, or omitted without departing from the spirit of present disclosure in this application.

First Modification

Figure 15:
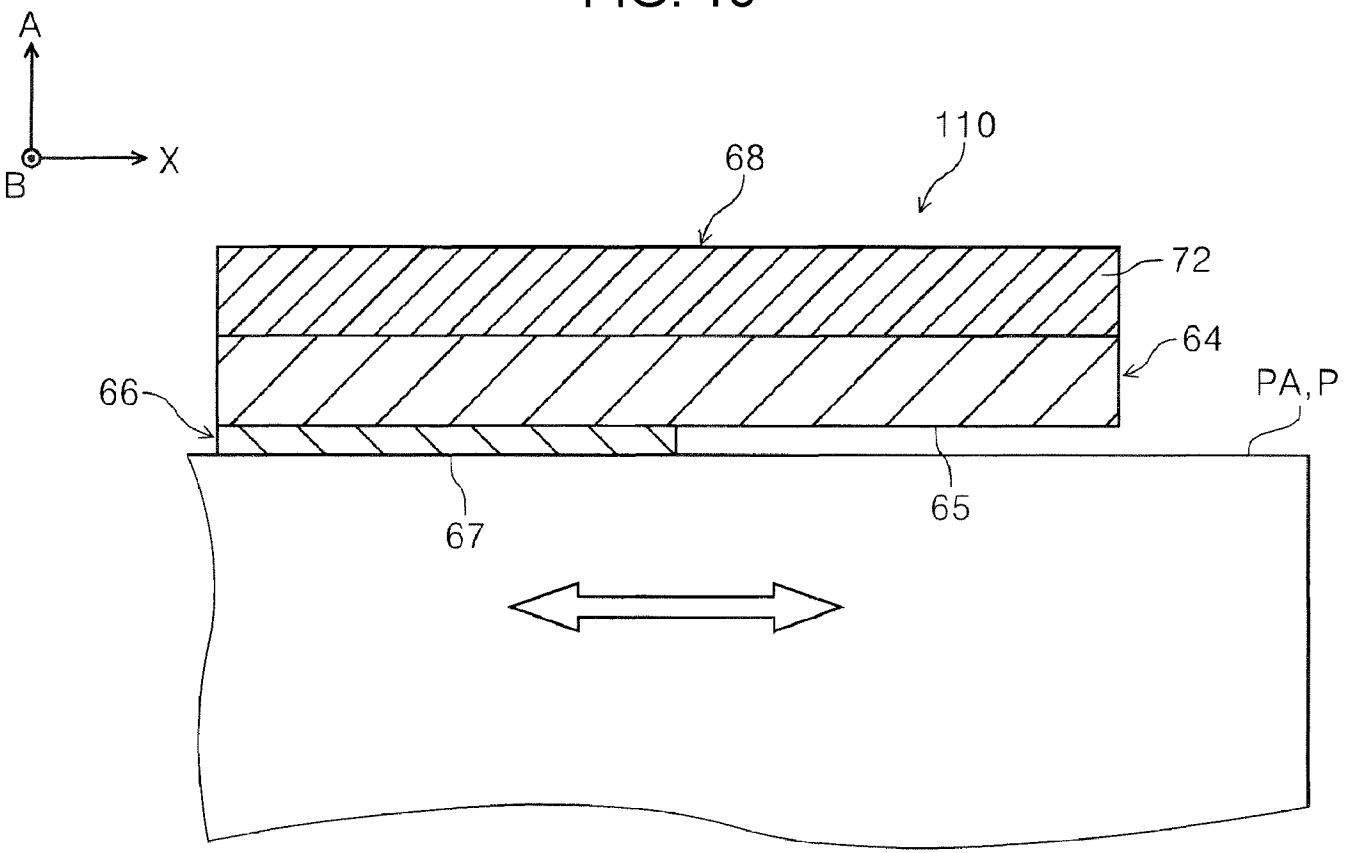
FIG. 15 schematically illustrates an alignment section in a postprocessing apparatus according to a first modification of the first embodiment.

As illustrated in FIG. 15, a side alignment section 110 may be formed as in a first modification of the foregoing first embodiment. The side alignment section 110 differs from the side alignment section 62 (see FIG. 7) in the first embodiment. More specifically, a first friction member 64 in the first modification is formed longer than that in the +X direction, and a second friction member 66 in the first modification is thinner than that in the first embodiment. The second friction member 66 is attached to the −X-directional half side of the −A-directional surface of the first friction member 64. In this way, the second friction member 66 may be attached to the first friction member 64.

Second Modification

Figure 16:
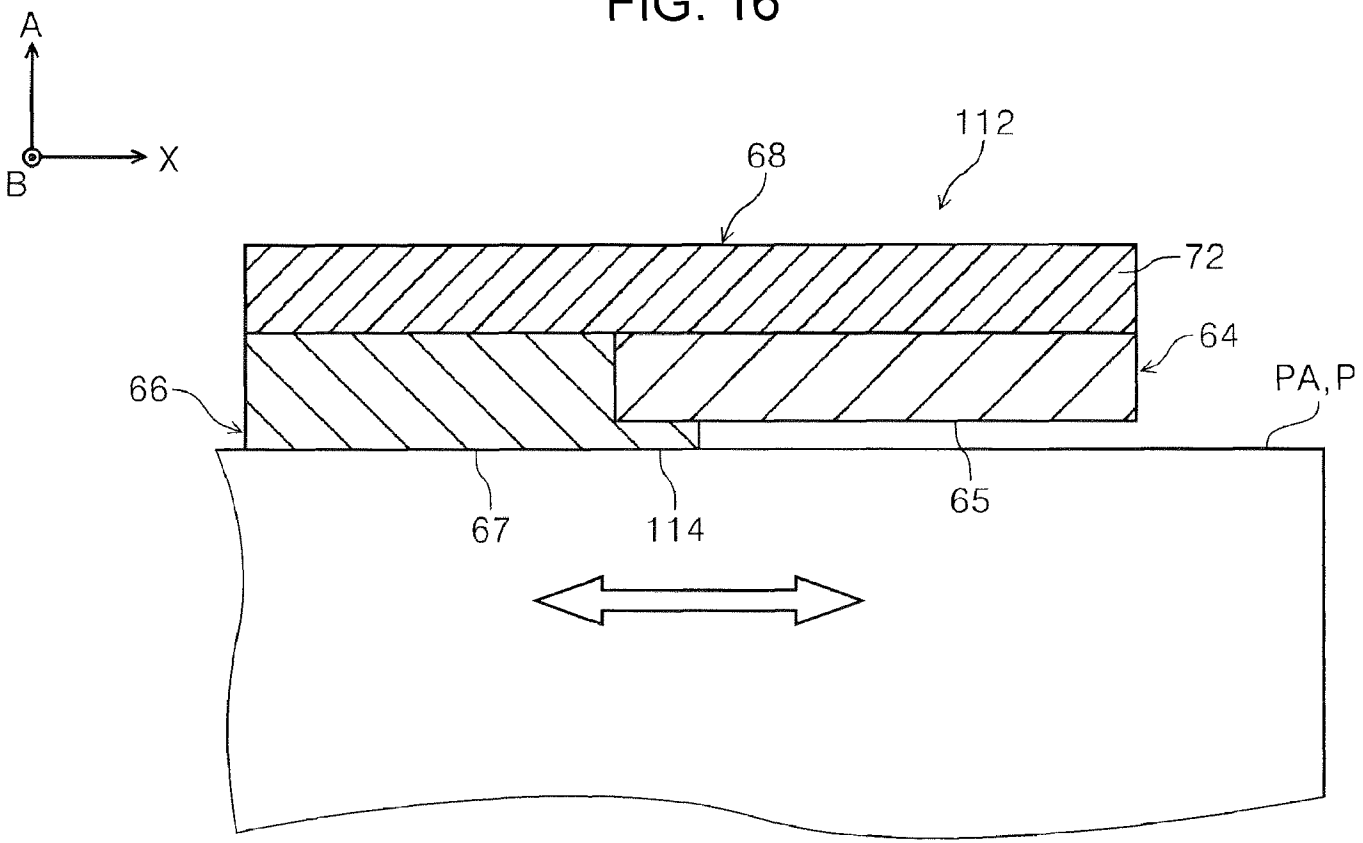
FIG. 16 schematically illustrates an alignment section in a postprocessing apparatus according to a second modification of the first embodiment.

As illustrated in FIG. 16, a side alignment section 112 may be formed as in a second modification of the foregoing first embodiment. The side alignment section 112 differs from the side alignment section 62 (see FIG. 7) in the first embodiment, in including a projection 114 formed on the +X-directional side of a second friction member 66. The projection 114 may be a sheet-shaped portion that protrudes in the +X direction from the +X- and −A-directional surfaces of the second friction member 66. The projection 114 covers the interface between a first friction member 64 and the second friction member 66 from the −A-directional side. The second friction member 66 may be attached to both the first friction member 64 and a mounting member 68.

Third Modification

Figure 17:
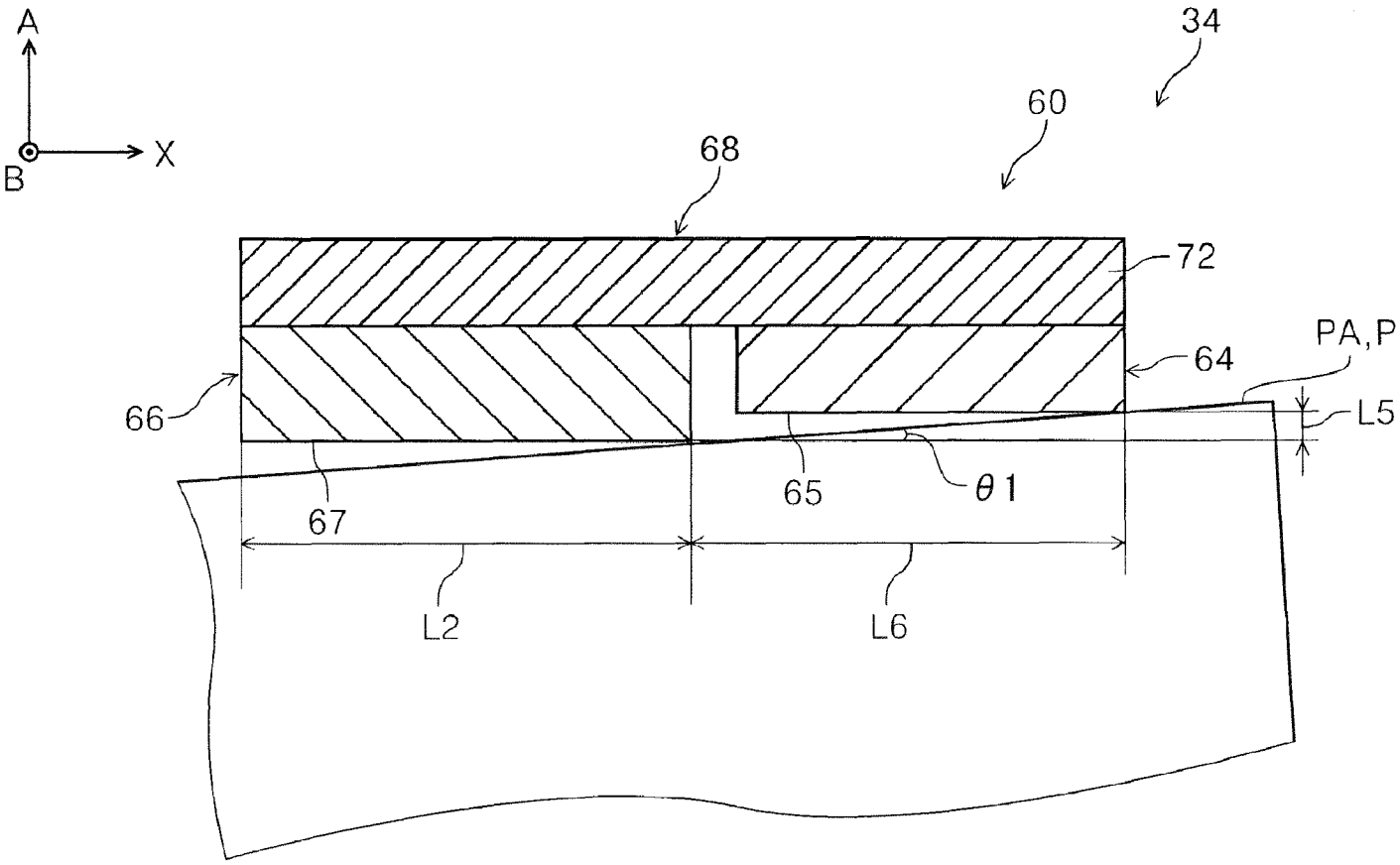
FIG. 17 schematically illustrates an alignment section in a postprocessing apparatus according to a third modification of the first embodiment.

As illustrated in FIG. 17, a first alignment surface 65 and a second alignment surface 67 are arranged so as to reserve a spacing therebetween in the +X direction, as in a third modification of the foregoing first embodiment. In this case, the direction between the +X-directional side of the first alignment surface 65 and the +X-directional side of the second alignment surface 67 is defined as a length L6 (mm); a paper sheet P forms an angle $\theta=\theta 1$ (deg) with the X-axis. This configuration can suppress the unexpected entry of the paper sheet P as long as length L5≤(length L6)×tan $\theta 1$ is satisfied. The configuration can suppress the first friction member 64 and the second friction member 66 from abutting against each other, even if a considerable manufacturing error arises upon the attaching of a first friction member 64 and a second friction member 66 to a mounting member 68. This is because the first alignment surface 65 is kept apart from the second alignment surface 67 in the +X direction. In short, the configuration can reduce the influence of the manufacturing error.

Other Modifications

As for the stacking unit 34 in the first embodiment, the alignment section 60 does not necessarily have to include a third friction member 78 with a third alignment surface 79. In addition, the third friction coefficient μ3 may or may not be higher than the first friction coefficient μ1, as long as the third friction coefficient μ3 is higher than the second friction coefficient μ2. Two side alignment sections 62 do not necessarily have to be disposed on the ±X-directional sides of the processing tray 42; alternatively, a single edge alignment section 62 may be disposed on one of the ±X-directional sides of the processing tray 42. The first alignment surfaces 65 do not necessarily have to have a friction coefficient that is entirely higher than the second friction coefficient μ2 in the +B direction; alternatively, the friction coefficient of the first alignment surfaces 65 may be partly the same as the second friction coefficient μ2 in the +B direction. Likewise, the friction coefficient of the first alignment surfaces 65 may also be partly the same as the second friction coefficient μ2 in the +X direction.

If each of the first friction members 64, the second friction members 66, and the third friction member 78 is stiff enough to withstand a force acting from the +A direction, they may be directly attached to the processing tray 42 without using the mounting members 68 and 82. The first alignment surfaces 65 may be formed on the respective mounting members 68. In this case, the first alignment surfaces 65 may be formed by subjecting the respective vertical walls 72 to a rough surface treatment.

The third friction member 78 may have a substantially H-shaped outline as viewed from the +A direction. The corner of each second friction member 66 closer to the corresponding first friction member 64 may be formed into a round or tapered shape. This configuration can help paper sheets P move from a first alignment surface 65 to the next second alignment surface 67. Furthermore, each first alignment surface 65 may be aligned with the third alignment surface 79 as viewed from the +A direction.

It should be noted that the above modified configurations of the stacking unit 34 in the first embodiment may also be applicable to both the stacking unit 90 in the second embodiment and the stacking unit 94 in the third embodiment.

What is claimed is:

1. A medium stacking apparatus comprising:

a placement section having a placement area in which one or more media that recorded medium are placed;

an alignment section that aligns downstream, leading edges, in a transport direction, of the media that were transported to the placement section;

a transport section that transports, to the alignment section, the media that were transported to the placement section; and a moving section that moves the media stacked on the placement section in a width direction, the width direction intersecting the transport direction, wherein the alignment section includes a first alignment surface having a first friction coefficient for contact with the media, and a second alignment surface having a second friction coefficient for contact with the media, the second friction coefficient being lower than the first friction coefficient, the first alignment surface and the second alignment surface are side by side in the width direction, and the second alignment surface is positioned upstream of the first alignment surface in the transport direction and closer to a center of the placement area in the width direction than the first alignment surface is.

2. The medium stacking apparatus according to claim 1, wherein the alignment section further includes a third alignment surface positioned closer to the center in the width direction than the second alignment surface is, the third alignment surface having a third friction coefficient for contact with the media, the third friction coefficient being higher than the second friction coefficient, the third alignment surface being positioned downstream of the second alignment surface in the transport direction.

3. The medium stacking apparatus according to claim 2, wherein the first alignment surface is positioned upstream of the third alignment surface in the transport direction.

4. The medium stacking apparatus according to claim 2, wherein the third alignment surface is positioned upstream of the first alignment surface in the transport direction.

5. The medium stacking apparatus according to claim 1, wherein the alignment section includes a plurality of first alignment surfaces and a plurality of second alignment surfaces, the plurality of first alignment surfaces are arranged on both sides of the placement area with respect to the center in the width direction, and the plurality of second alignment surfaces are arranged on both sides of the placement area with respect to the center in the width direction.

6. The medium stacking apparatus according to claim 1, wherein the first friction coefficient of the first alignment surface is higher than the second friction coefficient of the second alignment surface at least in a stacking direction of the media.

7. The medium stacking apparatus according to claim 1, wherein the alignment section further includes a first friction member provided with the first alignment surface and a mounting member to which the first friction member is attached.

8. The medium stacking apparatus according to claim 7, wherein the second alignment surface is formed on a second friction member, the second friction member being attached to at least one of the mounting member and the first friction member.

9. The medium stacking apparatus according to claim 7, wherein the second alignment surface is formed on the mounting member.

10. A postprocessing apparatus comprising:

the medium stacking apparatus according to claim 1; and a processing section that processes the plurality of media stacked on the placement section.

* * * * *